US009849054B2

(12) United States Patent
Jackson

(10) Patent No.: US 9,849,054 B2
(45) **Date of Patent: *Dec. 26, 2017**

(54) PATIENT POSITIONING SUPPORT STRUCTURE

(71) Applicant: Roger P. Jackson, Prairie Village, KS (US)

(72) Inventor: Roger P. Jackson, Prairie Village, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/573,959

(22) Filed: Oct. 16, 2012

(65) Prior Publication Data

US 2013/0111666 A1 May 9, 2013

Related U.S. Application Data

(63) Continuation-in-part of application No. 12/803,173, filed on Jun. 21, 2010, now Pat. No. 8,707,484, which (Continued)

(51) Int. Cl.
*A61G 13/00* (2006.01)
*A61G 13/04* (2006.01)

(Continued)

(52) U.S. Cl.
CPC ..... *A61G 13/0036* (2013.01); *A61G 13/0054* (2016.11); *A61G 13/02* (2013.01);

(Continued)

(58) Field of Classification Search
CPC .... A61G 13/0036; A61G 13/02; A61G 13/04; A61G 13/08; A61G 13/06; A61G 2013/0054; A61G 2203/12; A61G 13/0054

(Continued)

(56) References Cited

U.S. PATENT DOCUMENTS 377,377 A 2/1888 Ferry
392,743 A 11/1888 Millen (Continued)

FOREIGN PATENT DOCUMENTS

CN 2467091 Y 12/2001
DE 29810798 U 10/1999

(Continued)

OTHER PUBLICATIONS

Brochure of OSI on Modular Table System, pp. 1-15, date of first publication: Unknow.

(Continued)

*Primary Examiner* — Robert G Santos
*Assistant Examiner* — David R Hare
(74) *Attorney, Agent, or Firm* — Polsinelli PC

(57) ABSTRACT

An articulating patient support table comprises first and second patient support sections hingedly connected together along respective hinge ends. A longitudinal translation subassembly connected to a base by a position adjustable pedestal supports the first patient support section in cantilevered relationship. The position adjustment assembly includes a lift mechanism operable to raise and lower the longitudinal translation subassembly relative to the base and a pivot assembly operable to pivot the longitudinal translation subassembly fore and aft and side to side relative to the base.

7 Claims, 15 Drawing Sheets

Related U.S. Application Data is a continuation-in-part of application No. 12/460,702, filed on Jul. 23, 2009, now Pat. No. 8,060,960, which is a continuation of application No. 11/788,513, filed on Apr. 20, 2007, now Pat. No. 7,565,708, which is a continuation-in-part of application No. 11/159,494, filed on Jun. 23, 2005, now Pat. No. 7,343,635, which is a continuation-in-part of application No. 11/062,775, filed on Feb. 22, 2005, now Pat. No. 7,152,261.

(60) Provisional application No. 61/627,752, filed on Oct. 17, 2011, provisional application No. 60/798,288, filed on May 5, 2006.

(51) Int. Cl.
*A61G 13/02* (2006.01)
*A61G 13/06* (2006.01)
*A61G 13/08* (2006.01)

(52) U.S. Cl.
CPC ..... *A61G 13/04* (2013.01); *A61G 13/06* (2013.01); *A61G 13/08* (2013.01); *A61G 2203/12* (2013.01)

(58) Field of Classification Search
USPC ... 5/600, 601, 607, 608, 610, 611, 613, 617, 5/618
See application file for complete search history.

(56) References Cited

U.S. PATENT DOCUMENTS 430,635 A 6/1890 Fox
769,415 A 9/1904 Smock
987,423 A 3/1911 Barnett
1,032,743 A 7/1912 Courtney
1,046,430 A 12/1912 Beitz
1,098,209 A 5/1914 Allen
1,098,477 A 6/1914 Cahman
1,143,618 A 6/1915 Ewald
1,160,451 A 11/1915 Sanford
1,171,713 A 2/1916 Gilkerson
1,356,467 A 10/1920 Payne
1,404,482 A 1/1922 Sawyer
1,482,439 A 2/1924 McCullough
1,524,399 A 1/1925 Krueger
1,528,835 A 3/1925 McCullough
1,667,982 A 5/1928 Pearson
1,780,399 A 11/1930 Munson
1,799,692 A 4/1931 Knott
1,938,006 A 12/1933 Blanchard
1,990,357 A 2/1935 Ward
2,188,592 A 1/1940 Hosken et al.
2,261,297 A 11/1941 Frederick
2,411,768 A 11/1946 Welch
2,475,003 A 7/1949 Black
2,636,793 A 4/1953 Meyer
2,688,410 A 9/1954 Nelson
2,792,945 A 5/1957 Brenny
3,046,071 A 7/1962 Shampaine et al.
3,049,726 A 8/1962 Getz
3,281,141 A 10/1966 Smiley et al.
3,302,218 A 2/1967 Stryker
3,584,321 A * 6/1971 Buchanan ..... 5/601
3,599,964 A 8/1971 Magni
3,640,416 A 2/1972 Temple
3,766,384 A 10/1973 Anderson
3,814,414 A 6/1974 Chapa
3,827,089 A 8/1974 Grow
3,832,742 A 9/1974 Stryker
3,868,103 A * 2/1975 Pageot ..... A61G 13/02 137/596
3,937,054 A 2/1976 Hortvet et al.
3,988,790 A 11/1976 Mracek et al.
4,101,120 A 7/1978 Seshima
4,131,802 A 12/1978 Braden et al.
4,144,880 A 3/1979 Daniels
4,148,472 A * 4/1979 Rais ..... A61G 13/02 378/209
4,175,550 A 11/1979 Leininger et al.
4,186,917 A 2/1980 Rais et al.
4,195,829 A * 4/1980 Reser ..... A61G 13/02 5/607
4,227,269 A 10/1980 Johnston
4,230,100 A 10/1980 Moon
4,244,358 A 1/1981 Pyers
4,292,962 A 10/1981 Krause
4,391,438 A 7/1983 Heffington, Jr.
4,435,861 A 3/1984 Lindley
4,474,364 A 10/1984 Brendgord
4,503,844 A 3/1985 Siczek
4,552,346 A 11/1985 Schnelle et al.
4,712,781 A 12/1987 Watanabe
4,715,073 A 12/1987 Butler
4,718,077 A 1/1988 Moore et al.
4,763,643 A 8/1988 Vrzalik
4,771,785 A 9/1988 Duer
4,830,337 A 5/1989 Ichiro et al.
4,850,775 A 7/1989 Lee et al.
4,862,529 A 9/1989 Peck
4,872,656 A * 10/1989 Brendgord ..... A61G 13/0036 5/601
4,872,657 A * 10/1989 Lussi ..... 5/608
4,887,325 A 12/1989 Tesch
4,937,901 A 7/1990 Brennan
4,939,801 A 7/1990 Schaal et al.
4,944,500 A 7/1990 Mueller et al.
4,953,245 A 9/1990 Jung
4,970,737 A 11/1990 Sagel
4,989,848 A 2/1991 Monroe
5,013,018 A 5/1991 Sicek et al.
5,088,706 A 2/1992 Jackson
5,131,103 A 7/1992 Thomas et al.
5,131,105 A * 7/1992 Harrawood et al. ..... 5/607
5,131,106 A 7/1992 Jackson
5,161,267 A 11/1992 Smith
5,163,890 A 11/1992 Perry, Jr.
5,181,289 A 1/1993 Kassai
5,208,928 A 5/1993 Kuck et al.
5,210,887 A 5/1993 Kershaw
5,210,888 A 5/1993 Canfield
5,230,112 A * 7/1993 Harrawood et al. ..... 5/607
5,231,741 A * 8/1993 Maguire ..... 27/12
5,239,716 A 8/1993 Fisk
5,274,862 A 1/1994 Palmer, Jr.
5,294,179 A 3/1994 Rudes et al.
5,333,334 A 8/1994 Kassai
5,393,018 A 2/1995 Roth et al.
5,444,882 A 8/1995 Andrews et al.
5,461,740 A 10/1995 Pearson
5,468,216 A 11/1995 Johnson et al.
5,487,195 A 1/1996 Ray
5,499,408 A 3/1996 Nix
5,524,304 A 6/1996 Shutes
5,544,371 A 8/1996 Fuller
5,579,550 A 12/1996 Bathrick
5,588,705 A 12/1996 Chang
5,613,254 A 3/1997 Clayman et al.
5,640,730 A 6/1997 Godette
5,645,079 A 7/1997 Zahiri et al.
5,658,315 A 8/1997 Lamb et al.
5,659,909 A 8/1997 Pfeuffer et al.
5,673,443 A 10/1997 Marmor
5,737,781 A 4/1998 Votel
5,754,997 A * 5/1998 Lussi et al. ..... 5/618
5,774,914 A 7/1998 Johnson et al.
5,794,286 A 8/1998 Scott et al.
5,829,077 A 11/1998 Neige
5,862,549 A 1/1999 Morton et al.
5,870,784 A 2/1999 Elliott
5,890,238 A 4/1999 Votel
5,901,388 A 5/1999 Cowan

(56) References Cited

U.S. PATENT DOCUMENTS 5,937,456 A 8/1999 Norris
5,940,911 A 8/1999 Wang
5,996,151 A 12/1999 Bartow et al.
6,000,076 A 12/1999 Webster et al.
6,035,465 A 3/2000 Rogozinski
6,049,923 A 4/2000 Ochiai
6,058,532 A 5/2000 Allen
6,109,424 A 8/2000 Doan
6,212,713 B1 4/2001 Kuck et al.
6,224,037 B1 5/2001 Novick
6,240,582 B1 * 6/2001 Reinke ..... A61B 6/0457 378/209
6,260,220 B1 * 7/2001 Lamb et al. ..... 5/607
6,282,736 B1 * 9/2001 Hand et al. ..... 5/608
6,282,738 B1 9/2001 Heimbrock et al.
6,286,164 B1 9/2001 Lamb et al.
6,287,241 B1 9/2001 Ellis
6,295,666 B1 10/2001 Takaura
6,295,671 B1 10/2001 Reesby et al.
6,315,564 B1 11/2001 Levisman
6,322,251 B1 11/2001 Ballhaus et al.
6,438,777 B1 8/2002 Bender
6,496,991 B1 12/2002 Votel
6,499,162 B1 12/2002 Lu
6,505,365 B1 1/2003 Hanson et al.
6,526,610 B1 * 3/2003 Hand et al. ..... 5/607
6,634,043 B2 10/2003 Lamb et al.
6,638,299 B2 10/2003 Cox
6,662,388 B2 12/2003 Friel
6,668,396 B2 12/2003 Wei
6,681,423 B2 1/2004 Zachrisson
6,701,553 B1 3/2004 Hand et al.
6,779,210 B1 8/2004 Kelly
6,791,997 B2 9/2004 Beyer et al.
6,794,286 B2 9/2004 Aoyama et al.
6,817,363 B2 11/2004 Biondo et al.
6,854,137 B2 2/2005 Johnson
6,857,144 B1 2/2005 Huang
6,885,165 B2 * 4/2005 Henley ..... A61B 6/0457 318/135
6,971,131 B2 12/2005 Bannister
6,971,997 B1 12/2005 Ryan et al.
7,003,828 B2 2/2006 Roussy
7,055,195 B2 6/2006 Roussy
7,089,612 B2 8/2006 Rocher et al.
7,103,931 B2 9/2006 Somasundaram et al.
7,137,160 B2 11/2006 Hand et al.
7,152,261 B2 * 12/2006 Jackson ..... 5/600
7,171,709 B2 2/2007 Weismiller
7,189,214 B1 * 3/2007 Saunders ..... 602/32
7,197,778 B2 4/2007 Sharps
7,213,279 B2 5/2007 Weismiller et al.
7,290,302 B2 11/2007 Sharps
7,331,557 B2 2/2008 Dewert
7,343,635 B2 * 3/2008 Jackson ..... 5/611
7,428,760 B2 * 9/2008 McCrimmon ..... A47C 19/045 5/11
7,437,785 B2 10/2008 Farooqui
7,565,708 B2 * 7/2009 Jackson ..... 5/611
7,596,820 B2 10/2009 Nielsen et al.
7,653,953 B2 2/2010 Lopez-Sansalvador
7,669,262 B2 3/2010 Skripps et al.
7,739,762 B2 * 6/2010 Lamb et al. ..... 5/618
7,874,030 B2 1/2011 Cho et al.
7,874,695 B2 1/2011 Jensen
7,882,583 B2 2/2011 Skripps
8,056,163 B2 * 11/2011 Lemire et al. ..... 5/611
8,060,960 B2 * 11/2011 Jackson ..... 5/611
8,381,331 B2 2/2013 Sharps et al.
8,584,281 B2 11/2013 Diel et al.
8,635,725 B2 1/2014 Tannoury et al.
8,677,529 B2 * 3/2014 Jackson ..... 5/600
8,707,476 B2 4/2014 Sharps
8,707,484 B2 * 4/2014 Jackson et al. ..... 5/611
8,719,979 B2 * 5/2014 Jackson ..... 5/608
8,826,474 B2 9/2014 Jackson
8,826,475 B2 9/2014 Jackson
8,839,471 B2 9/2014 Jackson
8,844,077 B2 9/2014 Jackson et al.
8,856,986 B2 10/2014 Jackson
D720,076 S 12/2014 Sharps et al.
8,938,826 B2 1/2015 Jackson
8,978,180 B2 3/2015 Jackson
9,180,062 B2 11/2015 Jackson
9,186,291 B2 11/2015 Jackson et al.
9,198,817 B2 12/2015 Jackson
9,205,013 B2 12/2015 Jackson
9,265,680 B2 2/2016 Sharps et al.
9,295,433 B2 3/2016 Jackson et al.
2001/0037524 A1 11/2001 Truwit
2002/0170116 A1 11/2002 Borders et al.
2003/0074735 A1 4/2003 Zachrisson
2003/0145383 A1 8/2003 Schwaegerle
2004/0098804 A1 5/2004 Varadharajulu et al.
2004/0133983 A1 * 7/2004 Newkirk et al. ..... 5/624
2004/0168253 A1 9/2004 Hand et al.
2004/0219002 A1 11/2004 Lenaers
2006/0123546 A1 6/2006 Horton et al.
2006/0185090 A1 8/2006 Jackson
2006/0248650 A1 11/2006 Skripps
2007/0056105 A1 3/2007 Hyre et al.
2007/0107126 A1 5/2007 Koch et al.
2007/0157385 A1 7/2007 Lemire et al.
2007/0169265 A1 7/2007 Saracen et al.
2007/0174965 A1 8/2007 Lemire et al.
2007/0192960 A1 8/2007 Jackson
2007/0266516 A1 11/2007 Cakmak
2008/0000028 A1 1/2008 Lemire et al.
2008/0216241 A1 9/2008 Mangiardi
2009/0126116 A1 5/2009 Lamb et al.
2009/0235456 A1 9/2009 Bock
2010/0037397 A1 2/2010 Wood
2010/0107790 A1 5/2010 Yamaguchi
2010/0192300 A1 8/2010 Tannoury et al.
2010/0223728 A1 9/2010 Hutchison et al.
2011/0099716 A1 * 5/2011 Jackson ..... 5/607
2011/0107516 A1 5/2011 Jackson
2011/0107517 A1 5/2011 Lamb et al.
2011/0197361 A1 8/2011 Hornbach et al.
2012/0005832 A1 1/2012 Turner et al.
2012/0144589 A1 6/2012 Skripps et al.
2012/0174319 A1 7/2012 Menkedick
2012/0198625 A1 8/2012 Jackson
2012/0246829 A1 10/2012 Lamb et al.
2012/0246830 A1 10/2012 Hornbach
2012/0255122 A1 10/2012 Diel et al.
2013/0111666 A1 5/2013 Jackson
2013/0133137 A1 5/2013 Jackson
2013/0198958 A1 8/2013 Jackson et al.
2013/0205500 A1 8/2013 Jackson
2013/0219623 A1 8/2013 Jackson
2013/0254992 A1 10/2013 Jackson
2013/0254993 A1 10/2013 Jackson
2013/0254994 A1 10/2013 Jackson
2013/0254995 A1 10/2013 Jackson
2013/0254996 A1 10/2013 Jackson
2013/0254997 A1 10/2013 Jackson
2013/0269710 A1 10/2013 Hight et al.
2013/0282234 A1 10/2013 Roberts et al.
2013/0312181 A1 11/2013 Jackson et al.
2013/0312187 A1 11/2013 Jackson
2013/0312188 A1 11/2013 Jackson
2013/0318718 A1 12/2013 Jackson
2013/0318719 A1 12/2013 Jackson
2013/0326812 A1 12/2013 Jackson
2013/0326813 A1 12/2013 Jackson
2014/0007349 A1 1/2014 Jackson
2014/0020181 A1 1/2014 Jackson
2014/0033436 A1 2/2014 Jackson
2014/0068861 A1 3/2014 Jackson et al.
2014/0082842 A1 3/2014 Jackson
2014/0218431 A1 3/2014 Jackson
2014/0218599 A1 3/2014 Jackson
2014/0109316 A1 4/2014 Jackson et al.

(56) References Cited

U.S. PATENT DOCUMENTS

| | | | |
|---|---|---|---|
| 2014/0173826 | A1 | 6/2014 | Jackson |
| 2014/0196212 | A1 | 7/2014 | Jackson |
| 2014/0201913 | A1 | 7/2014 | Jackson |
| 2014/0201914 | A1 | 7/2014 | Jackson |
| 2014/0208512 | A1 | 7/2014 | Jackson |
| 2014/0317847 | A1 | 10/2014 | Jackson |
| 2015/0007391 | A1 | 1/2015 | Xu |
| 2015/0059094 | A1 | 3/2015 | Jackson |
| 2015/0113733 | A1 | 4/2015 | Diel et al. |
| 2015/0150743 | A1 | 6/2015 | Jackson |
| 2016/0000620 | A1 | 1/2016 | Koch |
| 2016/0000621 | A1 | 1/2016 | Jackson et al. |
| 2016/0000626 | A1 | 1/2016 | Jackson et al. |
| 2016/0000627 | A1 | 1/2016 | Jackson et al. |
| 2016/0000629 | A1 | 1/2016 | Jackson et al. |
| 2016/0008201 | A1 | 1/2016 | Jackson |
| 2016/0038364 | A1 | 2/2016 | Jackson |
| 2016/0136027 | A1 | 5/2016 | Jackson |
| 2016/0166452 | A1 | 6/2016 | Jackson et al. |
| 2016/0213542 | A1 | 7/2016 | Jackson |

FOREIGN PATENT DOCUMENTS

| | | | |
|---|---|---|---|
| EP | 0885598 | | 12/1998 |
| EP | 2226010 | B1 | 6/2014 |
| GB | 569758 | | 6/1945 |
| GB | 810956 | | 3/1959 |
| JP | S53763 | | 1/1978 |
| JP | 2000060995 | | 2/2000 |
| JP | 2000-116733 | | 4/2000 |
| SU | 371359 | | 2/1973 |
| WO | 9907320 | | 2/1999 |
| WO | WO 00/07537 | | 2/2000 |
| WO | WO 00/62731 | | 10/2000 |
| WO | 0160308 | | 8/2001 |
| WO | WO 02/078589 | A1 | 10/2002 |
| WO | 03070145 | | 8/2003 |
| WO | WO 2007/130679 | A2 | 11/2007 |
| WO | 2009054969 | | 4/2009 |
| WO | 2009100692 | | 8/2009 |
| WO | WO2010/051303 | A1 | 5/2010 |

OTHER PUBLICATIONS

Brochure of Smith & Nephew on Spinal Positioning System, 2003, 2004.

Complaint for Patent Infringement, *Jackson* v. *Mizuho Orthopedic Sys., Inc*., No. 4:12-CV-01031 (W.D. Mo. Aug. 7, 2012).

First Amended Complaint for Patent Infringement and Correction of Inventorship, *Jackson* v. *Mizuho Orthopedic Sys., Inc*., No. 4:12-CV-01031 (W.D. Mo. Sep. 21, 2012).

Defendant Mizuho Orthopedic Systems, Inc.'s Answer to First Amended Complaint and Counterclaims, *Jackson* v. *Mizuho Orthopedic Sys., Inc*., No. 4:12-CV-01031 (W.D. Mo. Nov. 1, 2012).

Plaintiff Roger P. Jackson, MD's, Reply to Counterclaims, *Jackson* v. *Mizuho Orthopedic Sys., Inc*., No. 4:12-CV-01031 (W.D. Mo. Nov. 26, 2012).

Roger P. Jackson's Disclosure of Asserted Claims and Preliminary Infringement Contentions, *Jackson* v. *Mizuho Orthopedic Sys., Inc*., No. 4:12-CV-01031 (W.D. Mo. Jan. 4, 2013).

Second Amended Complaint for Patent Infringement, for Correction of Inventorship, for Breach of a Non-Disclosure and Confidentiality Agreement, and for Misappropriation of Dr. Jackson's Right of Publicity, *Jackson* v. *Mizuho Orthopedic Sys., Inc*., No. 4:12-CV-01031 (W.D. Mo. Jan. 28, 2013).

Defendant Mizuho Orthopedic Systems, Inc.'s Answer to Second Amended Complaint and Counterclaims, *Jackson* v. *Mizuho Orthopedic Sys., Inc*., No. 4:12-CV-01031 (W.D. Mo. Feb. 19, 2013).

Defendant Mizuho Osi's Invalidity Contentions Pursuant to the Parties' Joint Scheduling Order, *Jackson* v. *Mizuho Orthopedic Sys., Inc*., No. 4:12-CV-01031 (W.D. Mo. Feb. 22, 2013).

Plaintiff Roger P. Jackson, MD's, Reply to Second Counterclaims, *Jackson* v. *Mizuho Orthopedic Sys., Inc*., No. 4:12-CV-01031 (W.D. Mo. Mar. 12, 2013).

Roger P. Jackson, MD's Disclosure of Proposed Terms to be Construed, *Jackson* v. *Mizuho Orthopedic Sys., Inc*., No. 4:12-CV-01031 (W.D. Mo. Apr. 5, 2013).

Defendant Mizuho Orthopedic Systems, Inc.'s Disclosure of Proposed Terms and Claim Elements for Construction, *Jackson* v. *Mizuho Orthopedic Sys., Inc*., No. 4:12-CV-01031 (W.D. Mo. Apr. 5, 2013).

Mizuho Orthopedic Systems, Inc.'s Disclosure of Proposed Claim Constructions and Extrinsic Evidence, *Jackson* v. *Mizuho Orthopedic Sys., Inc*., No. 4:12-CV-01031 (W.D. Mo. May 13, 2013).

Plaintiff Roger P. Jackson, MD's Disclosure of Preliminary Proposed Claim Constructions, *Jackson* v. *Mizuho Orthopedic Sys., Inc*., No. 4:12-CV-01031 (W.D. Mo. May 13, 2013).

Defendant Mizuho Osi's Amended Invalidity Contentions Pursuant to the Parties' Joint Scheduling Order, *Jackson* v. *Mizuho Orthopedic Sys., Inc*., No. 4:12-CV-01031 (W.D. Mo. May 15, 2013).

Joint Claim Construction Chart and Joint Prehearing Statement, *Jackson* v. *Mizuho Orthopedic Sys., Inc*., No. 4:12-CV-01031 (W.D. Mo. Jun. 7, 2013).

Defendant Mizuho Orthopedic Systems, Inc.'s Objections and Responses to Plaintiff's First Set of Interrogatories, *Jackson* v. *Mizuho Orthopedic Sys., Inc*., No. 4:12-CV-01031 (W.D. Mo. Jun. 24, 2013).

Defendant Mizuho Orthopedic Systems, Inc.'s Opening Claim Construction Brief, *Jackson* v. *Mizuho Orthopedic Sys., Inc*., No. 4:12-CV-01031 (W.D. Mo. Jul. 31, 2013).

Plaintiff Roger P. Jackson, MD's Opening Claim Construction Brief, *Jackson* v. *Mizuho Orthopedic Sys., Inc*., No. 4:12-CV-01031 (W.D. Mo. Jul. 31, 2013).

Appendix A Amended Infringement Contentions Claim Chart for Mizuho's Axis System Compared to U.S. Pat. No. 7,565,708, *Jackson* v. *Mizuho Orthopedic Sys., Inc*., No. 4:12-CV-01031 (W.D. Mo. Aug. 12, 2013).

Appendix B Amended Infringement Contentions Claim Chart for Mizuho's Axis System Compared to U.S. Pat. No. 8,060,960, *Jackson* v. *Mizuho Orthopedic Sys., Inc*., No. 4:12-CV-01031 (W.D. Mo. Aug. 12, 2013).

Appendix C Amended Infringement Contentions Claim Chart for Mizuho's Proaxis System Compared to U.S. Pat. No. 7,565,708, *Jackson* v. *Mizuho Orthopedic Sys., Inc*., No. 4:12-CV-01031 (W.D. Mo. Aug. 12, 2013).

Appendix D Amended Infringement Contentions Claim Chart for Mizuho's Proaxis System Compared to U.S. Pat. No. 8,060,960, *Jackson* v. *Mizuho Orthopedic Sys., Inc*., No. 4:12-CV-01031 (W.D. Mo. Aug. 12, 2013).

Plaintiff Roger P. Jackson, MD's Responsive Claim Construction Brief, *Jackson* v. *Mizuho Orthopedic Sys., Inc*., No. 4:12-CV-01031 (W.D. Mo. Aug. 16, 2013).

Defendant Mizuho Orthopedic Systems, Inc's Brief in Response to Plaintiff's Opening Claim Construction Brief, *Jackson* v. *Mizuho Orthopedic Sys., Inc*., No. 4:12-CV-01031 (W.D. Mo. Aug. 16, 2013).

Plaintiff Roger P. Jackson, MD's Suggestions in Support of His Motion to Strike Exhibit A of Mizuho's Opening Claim Construction Brief, *Jackson* v. *Mizuho Orthopedic Sys., Inc*., No. 4:12-CV-01031 (W.D. Mo. Aug. 16, 2013).

Defendant Mizuho Orthopedic Systems, Inc.'s Opposition to Plaintiff's Motion to Strike, *Jackson* v. *Mizuho Orthopedic Sys., Inc*., No. 4:12-CV-01031 (W.D. Mo. Sep. 3, 2013).

Transcript of Claim Construction Hearing, *Jackson* v. *Mizuho Orthopedic Sys., Inc*., No. 4:12-CV-01031 (W.D. Mo. Oct. 11, 2013).

Plaintiff Roger P. Jackson, MD's Claim Construction Presentation for U.S. District Judge Nanette K. Laughrey, *Jackson* v. *Mizuho Orthopedic Sys., Inc*., No. 4:12-CV-01031 (W.D. Mo. Oct. 11, 2013).

Mizuho's Claim Construction Argument, *Jackson* v. *Mizuho Orthopedic Sys., Inc*., No. 4:12-CV-01031 (W.D. Mo. Oct. 11, 2013).

Order, *Jackson* v. *Mizuho Orthopedic Sys., Inc*., No. 4:12-CV-01031 (W.D. Mo. Apr. 4, 2014).

(56) References Cited

OTHER PUBLICATIONS

Canadian Office Action, CA2803110, dated Mar. 5, 2015.
Chinese Office Action, CN 201180039162.0, dated Jan. 19, 2015.
European Search Report, EP11798501.0, dated Mar. 30, 2015.
Australian Patent Examination Report No. 2, AU2014200274, dated Oct. 9, 2015.
Japanese Office Action, JP 2014-132463, dated Jun. 18, 2015.
Japanese Office Action, JP 2014-142074, dated Jun. 18, 2015.
Quayle Action, U.S. Appl. No. 14/792,216, dated Sep. 9, 2015.
Brochure of OSI on Modular Table System 90D, pp. 1-15, date of first publication: Unknown.
Pages from website http://www.schaerermayfieldusa.com, pp. 1-5, date of first publication: Unknown.
European Examination Report, EP11798501.0, dated Nov. 12, 2015.
Japanese Final Rejection (English version), JP 2014-142074, dated Dec. 6, 2015.
International Search Report and Written Opinion of the International Searching Authority, PCT/US2015/039400, dated Dec. 7, 2015, 13 pages.
Japanese Office Action, JP 2016-041088, dated Apr. 12, 2016.
U.S. Appl. No. 15/189,862, filed Jun. 22, 2016, Jackson et al.
U.S. Appl. No. 15/189,890, filed Jun. 22, 2016, Jackson et al.
U.S. Appl. No. 15/207,599, filed Jul. 12, 2016, Jackson.
U.S. Appl. No. 15/210,339, filed Jul. 14, 2016, Jackson et al.
U.S. Appl. No. 15/234,209, filed Aug. 11, 2016, Jackson et al.
U.S. Appl. No. 15/234,556, filed Aug. 11, 2016, Jackson et al.
U.S. Appl. No. 15/341,167, filed Nov. 2, 2016, Jackson et al.
U.S. Appl. No. 15/421,994, filed Feb. 1, 2017, Jackson et al.
U.S. Appl. No. 15/431,439, filed Feb. 13, 2017, Jackson.

* cited by examiner

PATIENT POSITIONING SUPPORT STRUCTURE

CROSS-REFERENCE TO RELATED APPLICATIONS

This application claims the benefit of U.S. Provisional Application No. 61/627,752, which was filed Oct. 17, 2011, and which is incorporated by reference herein. This application is a continuation-in-part of U.S. application Ser. No. 12/803,173, filed Jun. 21, 2010, which is a continuation-in-part of U.S. application Ser. No. 12/460,702, filed Jul. 23, 2009, now U.S. Pat. No. 8,060,960, which is a continuation of U.S. application Ser. No. 11/788,513 filed Apr. 20, 2007, now U.S. Pat. No. 7,565,708, which claimed the benefit of U.S. Provisional Application No. 60/798,288, filed May 5, 2006 and is a continuation-in-part of U.S. application Ser. No. 11/159,494 filed Jun. 23, 2005, now U.S. Pat. No. 7,343,635, which is a continuation-in-part of U.S. application Ser. No. 11/062,775, filed Feb. 22, 2005, now U.S. Pat. No. 7,152,261.

BACKGROUND OF THE INVENTION

The present disclosure is broadly concerned with structure for use in supporting and maintaining a patient in a desired position during examination and treatment, including medical procedures such as imaging, surgery and the like. More particularly, it is concerned with structure having patient supports that can be adjusted to allow a surgeon to selectively position the patient for convenient access to the surgical field and provide for manipulation of the patient during surgery including the tilting, angulation or bending of a trunk and/or a joint of a patient while in a generally supine, prone or lateral position. It is also concerned with structure for adjusting and/or maintaining the spatial relation between the inboard ends of the patient supports and for synchronized translation of the upper body of a patient as the inboard ends of the two patient supports are angled upwardly and downwardly.

Current surgical practice incorporates imaging techniques and technologies throughout the course of patient examination, diagnosis and treatment. For example, minimally invasive surgical techniques, such as percutaneous insertion of spinal implants involve small incisions that are guided by continuous or repeated intra-operative imaging. These images can be processed using computer software programs that product three dimensional images for reference by the surgeon during the course of the procedure. The patient support system should be constructed to permit unobstructed movement of the imaging equipment and other surgical equipment around, over and under the patient throughout the course of the surgical procedure without contamination of the sterile field.

It is also necessary that the patient support system be constructed to provide optimum access to the surgical field by the surgery team. Some procedures require positioning of portions of the patient's body in different ways at different times during the procedure. Some procedures, for example, spinal surgery, involve access through more than one surgical site or field. Since all of these fields may not be in the same plane or anatomical location, the patient support surfaces should be adjustable and capable of providing support in different planes for different parts of the patient's body as well as different positions or alignments for a given part of the body. Preferably, the support surface should be adjustable to provide support in separate planes and in different alignments for the head and upper trunk portion of the patient's body, the lower trunk and pelvic portion of the body as well as each of the limbs independently.

Certain types of surgery, such as orthopedic surgery, may require that the patient or a part of the patient be repositioned during the procedure while in some cases maintaining the sterile field. Where surgery is directed toward motion preservation procedures, such as by installation of artificial joints, dynamic stabilization systems, spinal ligaments and total disc prostheses, for example, the surgeon must be able to manipulate certain joints while supporting selected portions of the patient's body during surgery in order to facilitate the procedure. It is also desirable to be able to test the range of motion of the surgically repaired or stabilized joint and to observe the gliding movement of the reconstructed articulating prosthetic surfaces or the tension and flexibility of artificial ligaments, spacers and other types of dynamic stabilizers before the wound is closed. Such manipulation can be used, for example, to verify the correct positioning and function of an implanted prosthetic disc, spinal dynamic longitudinal connecting member, interspinous spacer or joint replacement during a surgical procedure. Where manipulation discloses binding, sub-optimal position or even crushing of the adjacent vertebrae, for example, as may occur with osteoporosis, the prosthesis can be removed and the adjacent vertebrae fused while the patient remains anesthetized. Injury which might otherwise have resulted from a "trial" use of the implant post-operatively will be avoided, along with the need for a second round of anesthesia and surgery to remove the implant or prosthesis and perform the revision, fusion or corrective surgery.

There is also a need for a patient support surface that can be articulated and angulated so that the patient can be moved when prone, for example, into an upwardly angled position or when supine into a downwardly angled position and whereby intra-operative bending (flexion and extension) of at least a portion of the spinal column can be achieved. The patient support surface must also be capable of easy, selective adjustment without necessitating removal and repositioning of the patient or causing substantial interruption of a surgical procedure.

For certain types of surgical procedures, for example spinal surgeries, it may be desirable to position the patient for sequential procedures done anteriorly, posteriorly and laterally. The patient support surface should be capable of providing correct positioning of the patient and optimum accessibility for the surgeon, as well as imaging equipment during such sequential procedures, when the patient is positioned prone, supine and lateral.

Articulated robotic arms are increasingly employed to perform surgical techniques. These units are generally designed to move short distances and to perform very precise work. Reliance on the patient support structure to perform any necessary gross movement of the patient can be beneficial, especially if the movements are synchronized or coordinated. Such units require a surgical support surface capable of smoothly performing the multi-directional movements which would otherwise be performed by trained medical personnel. There is thus a need in this application as well for integration between the robotics technology and the patient positioning technology.

While conventional operating tables generally include structure that permits tilting or rotation of a patient support surface about a longitudinal axis, previous surgical support devices have attempted to address the need for access by providing a cantilevered patient support surface on one end.

However, existing cantilevered patient support structures are unsatisfactory, incorporating either a massive base to counterbalance the extended support member or a large overhead frame structure to provide support from above. The enlarged base members associated with such cantilever designs are problematic in that they can and do obstruct the movement of C-arm and O-arm mobile fluoroscopic imaging devices and other equipment. Surgical tables with overhead frame structures are bulky and may require the use of dedicated operating rooms, since in some cases they cannot be moved easily out of the way. Neither of these designs is easily portable or storable.

Articulated operating tables that employ cantilevered support surfaces capable of upward and downward angulation require structure to compensate for variations in the spatial relation of the inboard ends of the supports as they are raised and lowered to an angled position either above or below a horizontal plane. As the inboard ends of the supports are raised or lowered, they form a triangle, with the horizontal plane of the table forming the base of the triangle. Unless the base is commensurately shortened or the frame or patient support structure is elongated, a gap will develop between the inboard ends of the supports.

Such up and down angulation of the patient supports also causes a corresponding flexion or extension, respectively, of the lumbar spine of a supine or prone patient positioned on the supports. Raising the inboard ends of the patient supports generally causes flexion of the lumbar spine of a prone patient with decreased lordosis and a coupled or corresponding posterior rotation of the pelvis around the hips. When the top of the pelvis rotates in a posterior direction, it pulls the lumbar spine and wants to move or translate the thoracic spine in a caudad direction, toward the patient's feet. If the patient's trunk, entire upper body and head and neck are not free to translate or move along the support surface in a corresponding caudad direction in association with the posterior pelvic rotation, excessive traction along the entire spine can occur, but especially in the lumbar region. Conversely, lowering the inboard ends of the patient supports with downward angulation causes extension of the lumbar spine of a prone patient with increased lordosis and coupled anterior pelvic rotation around the hips. When the top of the pelvis rotates in an anterior direction, it pushes and wants to translate the thoracic spine in a cephalad direction, toward the patient's head. If the patient's trunk and upper body are not free to translate or move along the longitudinal axis of the support surface in a corresponding cephalad direction during lumbar extension with anterior pelvic rotation, unwanted compression of the spine can result, especially in the lumbar region.

Thus, there remains a need for a patient support system that provides easy access for personnel and equipment, that can be positioned and repositioned easily and quickly in multiple planes without the use of massive counterbalancing support structure, and that does not require use of a dedicated operating room. There is also a need for such a system that permits upward and downward angulation of the inboard ends of the supports, either alone or in combination with rotation or roll about the longitudinal axis, all while maintaining the ends in a preselected spatial relation, and at the same time providing for coordinated translation of the patient's upper body in a corresponding caudad or cephalad direction to thereby avoid excessive compression or traction on the spine.

SUMMARY OF THE INVENTION

The present disclosure is directed to a patient positioning support structure that permits adjustable positioning, repositioning and selectively lockable support of a patient's head and upper body, lower body and limbs in up to a plurality of individual planes while permitting rolling or tilting, angulation or bending and other manipulations as well as full and free access to the patient by medical personnel and equipment. The system of the invention includes at least one support end or column that is actively adjustable and is used to control the height, up and down angular orientation and side-to side tilting of the patient support structure.

The patient support structure includes first and second patient support frames connected together by a hinge assembly to form a patient support framework. One of the support frames is adapted to support the patient's lower body, the other to support the upper body, although it is to be understood that the support frames could be adapted to selectively support either the upper or lower body. The first patient support frame is supported on a pedestal or base that incorporates a lift mechanism for raising or lowering the first patient support frame, a translation mechanism, a mechanism to angulate the first patient support frame up or down and a side to side roll mechanism for rolling the first patient support frame.

In one embodiment, the second patient support frame is hingedly supported above the floor only through connections through the first patient support frame. One or more actuators connected between the first and second patient support frames control the angular orientation between the frames.

In another embodiment, the second patient support frame is supported proximate a distal end to a second end support column assembly. The second patient support frame is pivotally connected to the second end support column assembly to permit the second patient support section to passively pivot about a distal end pivot axis extending parallel to the hinge axis of the patient support. The first patient support frame is mounted to the pedestal on a carrier that is slidable relative to the pedestal in response to fore and aft pivoting of a pivotal support frame linkage or raising and lowering of the lift mechanism.

Various objects and advantages of this patient support structure will become apparent from the following description taken in conjunction with the accompanying drawings wherein are set forth, by way of illustration and example, certain embodiments of this disclosure.

The drawings constitute a part of this specification, include exemplary embodiments, and illustrate various objects and features thereof.

DETAILED DESCRIPTION

Figure 1:
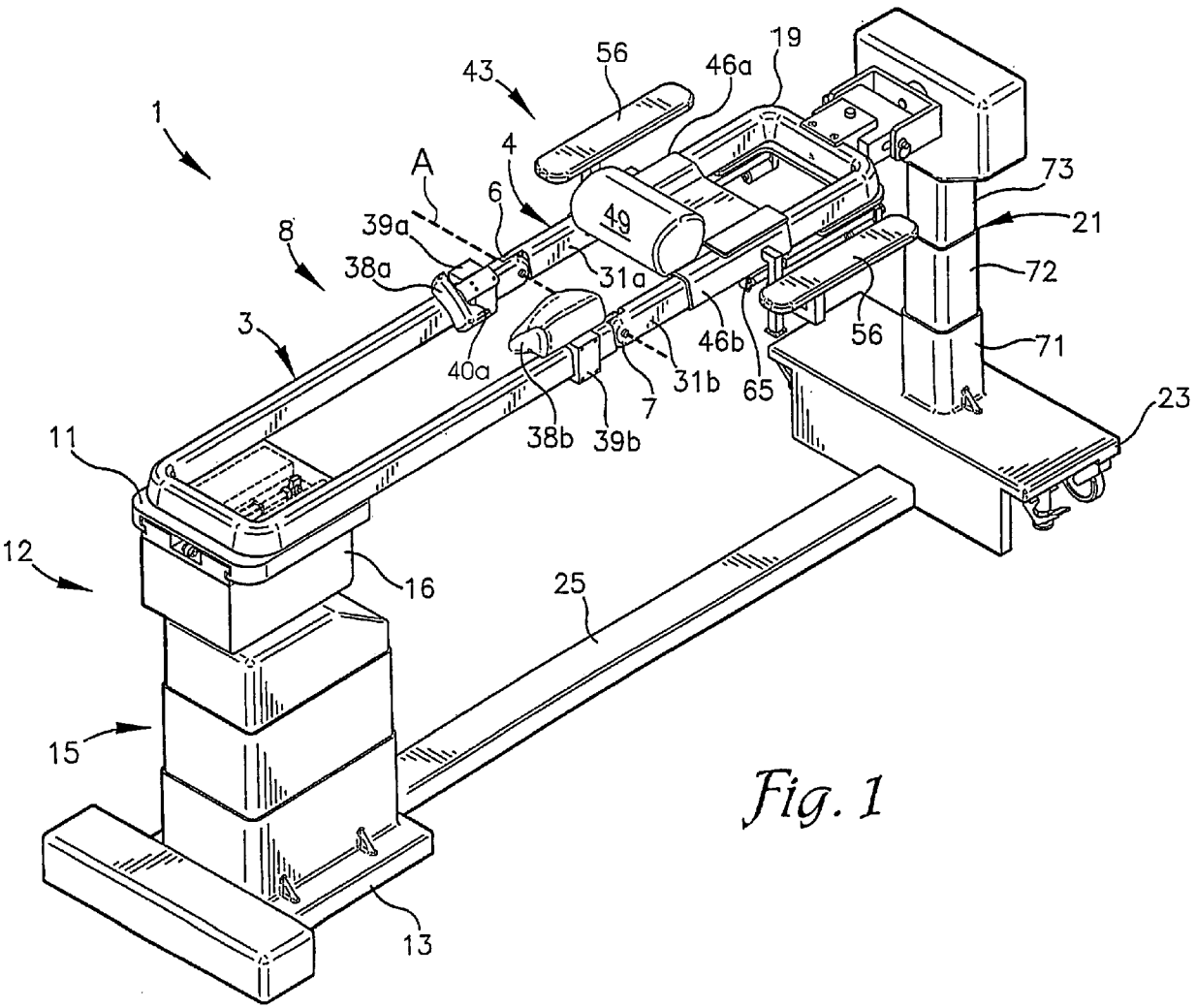
FIG. 1 is a perspective view of an embodiment of a patient positioning structure having an adjustable pedestal base shown in a raised alignment and with a head end support column shown raised and a patient support structure connected between the pedestal base and the head end support column shown in a horizontal alignment.

As required, detailed embodiments of the patient positioning support structure are disclosed herein; however, it is to be understood that the disclosed embodiments are merely exemplary of the apparatus, which may be embodied in various forms. Therefore, specific structural and functional details disclosed herein are not to be interpreted as limiting, but merely as a basis for the claims and as a representative basis for teaching one skilled in the art to variously employ the disclosure in virtually any appropriately detailed structure.

Referring now to the drawings, an embodiment of a patient positioning and support assembly, table or system according to the disclosure is generally designated by the reference numeral 1 and is depicted in FIGS. 1-12. The assembly 1 includes first and second patient support sections, frames or structures 3 and 4 connected together by spaced apart opposed hinges 6 and 7 to form an articulated patient support or patient support framework 8. The first patient support frame 3 may be referred to as the lower body or foot end support frame 3 and the second patient support frame 4 may be referred to as the upper body or head end support frame 4. Hinges 6 and 7 are formed or secured on hinge ends of the patient support frames 3 and 4, such that the patient support frames 3 and 4 are connected together along a hinge axis, which is denoted by the letter A, that is substantially perpendicular to a longitudinal axis of the patient positioning and support assembly 1 and also substantially parallel with the floor. The hinges 6 and 7 enable rotation or angulation about the associated hinge axis A of the frames 3 and 4 relative to one another.

In the embodiment shown in FIGS. 1-12, the lower body support frame 3 is supported on a carrier 11, or longitudinal translation subassembly, which is connected to and supported by an adjustable pedestal 12. The pedestal 12 includes a foot end base 13, a lift assembly or mechanism 15 operable to raise and lower the carrier 11 relative to the base 13 and a pedestal pivot assembly 16 operable to pivot the carrier 11 fore and aft and side to side relative to the base 13. As used herein the base 13 generally comprises the lower portion of the pedestal 12 or associated structure that is adapted to contact or be positioned in close contact with the floor for supporting the patient support assembly 1.

The carrier 11 and the attached lower body support frame 3 slide or translate relative to the pedestal 12 as the pedestal pivot assembly 16 pivots the carrier 11 fore and aft relative to the base 13. The carrier 11 slides parallel to a longitudinal axis of the lower body support frame 3.

The upper body support frame 4 is pivotally and rotatably supported at its distal end or head end 19 on a second end support column 21 supported on a second end base 23. The second end support column 21 telescopes or vertically translates to adjust the height of the head end of the upper body support frame 4. The foot end base 13 and second end base 23 are interconnected by a beam 25 or the like so that the spacing between the pedestal 12 and the second end support column 21 is fixed. The upper body support frame 4 freely pivots and rotates relative to the second end support column 21 to allow the upper body support frame 4 to pivot and rotate in response to raising or lowering, fore and aft pivoting or side to side rotation of the lower body support frame 3 in response to adjustments to the pedestal 12. Operation of the pedestal 12 and other adjustments to the patient support assembly 1 may be controlled by a computer controller 26 shown schematically in FIG. 2.

Figure 3:
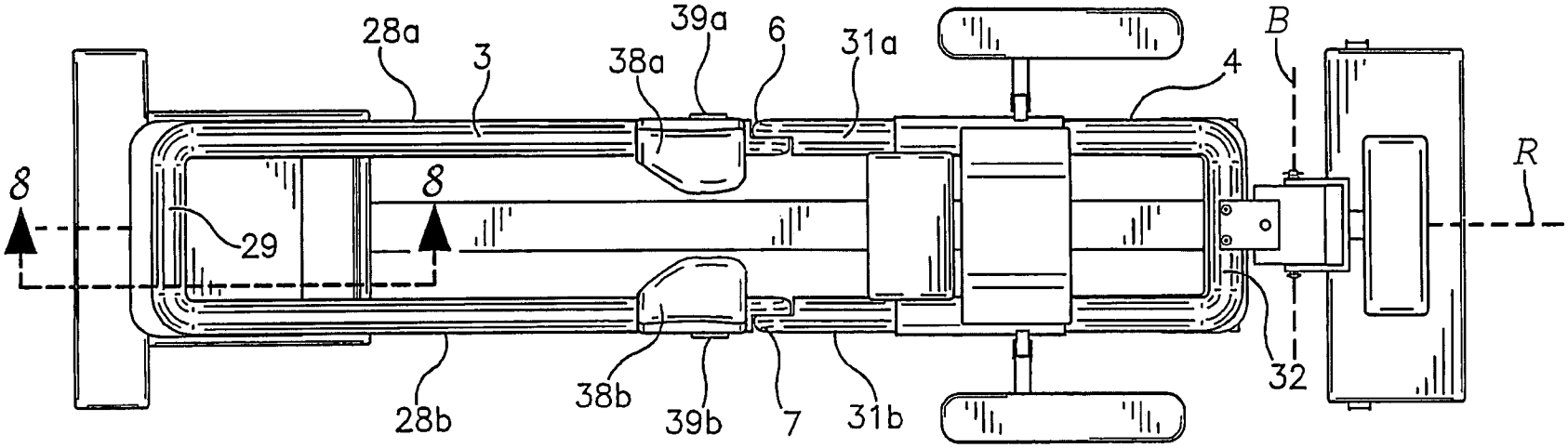
FIG. 3 is a top view of the patient positioning structure of FIG. 1.

The lower body support frame 3, connected to pedestal 12, is adapted to support the lower portion of a patient including the legs and up to the waist. The upper body support frame 4 is adapted to support the torso, arms and head of a patent. As best seen in FIG. 3, each patient support frame 3 and 4 is a generally U-shaped open framework with a pair of elongate, generally parallel spaced apart arms or support spars. The lower body support frame 3 includes spars 28*a* and 28*b* connected across a foot end by foot end cross bar 29. The upper body support frame 4 includes spars 31*a* and 31*b* connected across a head end by head end cross bar 32. The spars 28*a*, 28*b* and 31*a*, 31*b* are spaced so as to allow a prone patient's belly to depend therebetween. The lower body support frame 3 is illustrated with longer spars 28*a* and 28*b* than the spars 31*a* and 31*b* of the upper body support frame 4 to accommodate the longer, lower body of a patient. It is foreseen that all of the spars, and the patient support frames 3 and 4 may also be of equal length, or that the spars of upper body support frame 4 could be longer than the spars of the lower body support frame 3, so that the overall length of frame 4 will be greater than that of frame 3. It is also foreseen that a patient could be supported on the support framework 8 with his head supported on the first support frame 3 over the pedestal 12 and with his legs supported on the second support frame 4. An optional cross brace (not shown) may be provided between the longer spars 28*a* and 28*b* of the lower body support frame 3 to provide additional stability and support. However, any cross brace is located so as to not substantially hinder dependence of the patient's belly between the spars 28*a*, 28*b* and 31*a*, 31*b*, or between the hinges 6 and 7. Hinges 6 and 7 connecting the first and second patient support frames 3 and 4 are connected between inner ends of spars 28*a* and 31*a* and spars 28*b* and 31*b*. It is foreseen that the spars 28*a*, 28*b* of the lower body support frame 3 may be shaped so as to allow a patient's legs to depend therebetween. For example, as shown in FIG. 1A, the spars 28*a*, 28*b* may be space farther apart, outwardly bowed, or otherwise shaped or contoured so as to allow a patient's legs to depend therebetween. For example, the spars may be spaced wider or offset with side-to-side hinges 6, 7, to provide more room for the legs, such as but not limited to when a patient's legs are supported by a sling 28*c* suspended from the spars 28*a*, 28*b*.

Figure 1A:
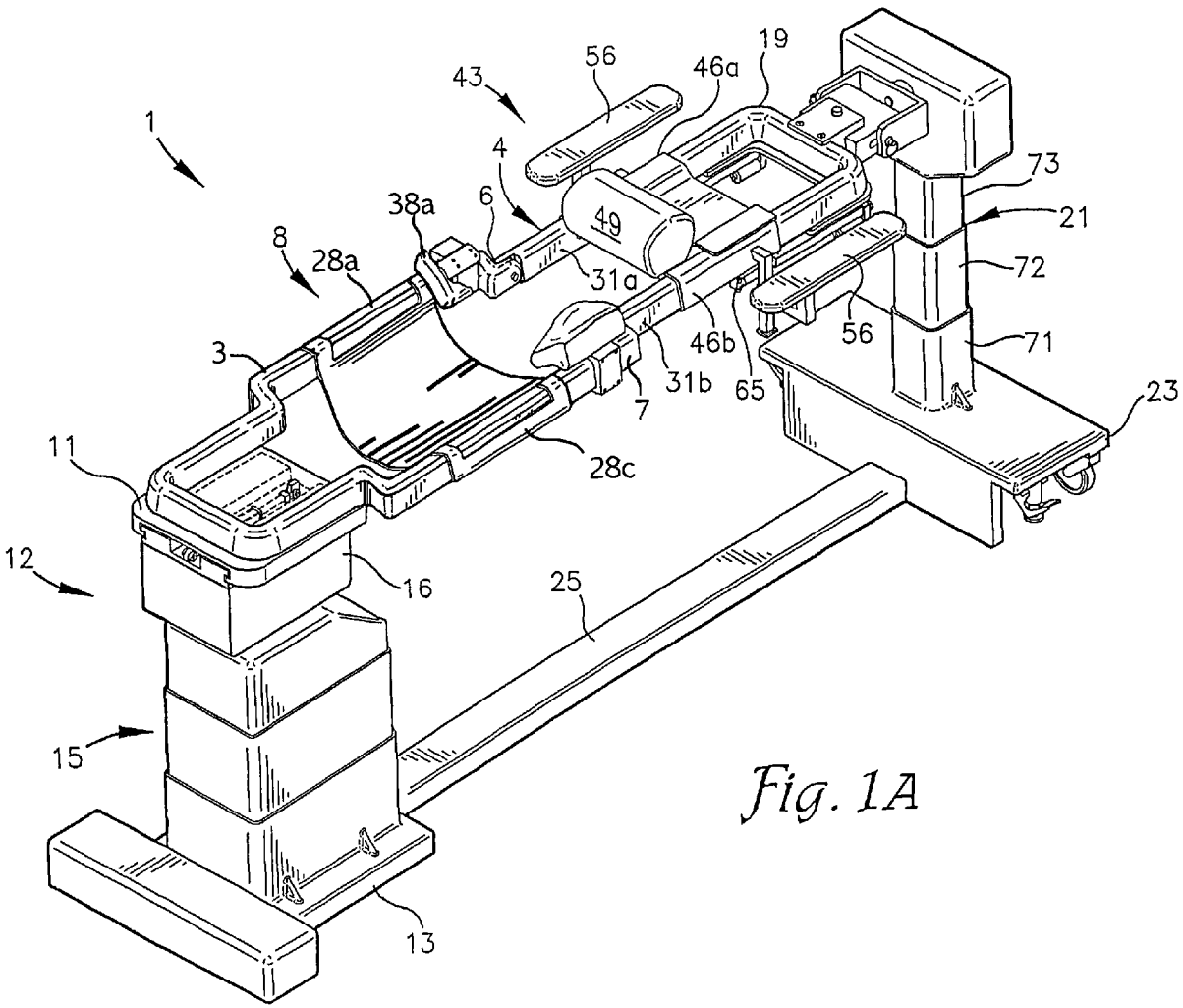
FIG. 1A is a perspective view of another embodiment of the patient positioning structure of FIG. 1.
Figure 2:
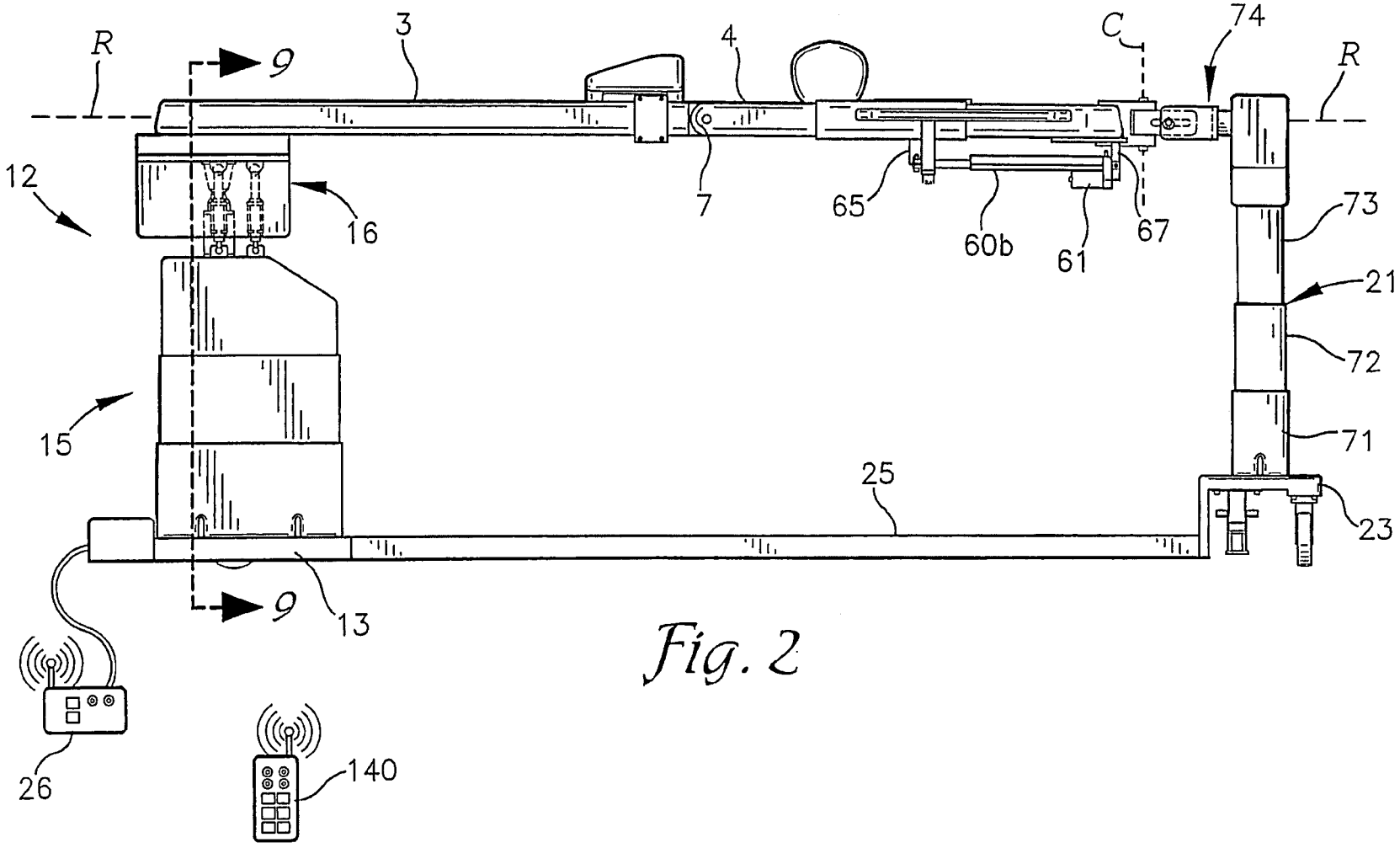
FIG. 2 is a side, elevational view of the patient positioning structure as shown in FIG. 1 with a controller and remote control unit shown schematically.

As best seen in FIGS. 1-3, the lower body support frame 3 is equipped with a pair of hip or lumbar support pads 38*a* and 38*b* that are selectively positionable for supporting the hips of a patient and are held in place by a pair of clamp style brackets or hip pad mounts 39*a*, 39*b* that surmount the respective spars 28*a* and 28*b*. The hip pads 38*a* and 38*b* may be shaped or contoured, such as but not limited to as is shown in FIGS. 3, 10-11 and 13-14, so as to allow the patient's belly to depend therebetween without excessively pinching or compressing the patient's body. Each of the hip pad mounts 39*a* and 39*b* is connected to a hip pad plate 40*a* and 40*b* (not shown) respectively that extend at a downward angle. The hip pads 38*a* and 38*b* are thus supported at an angle that is pitched or directed toward the longitudinal center axis of the supported patient. It is foreseen that the plates 40*a* and 40*b* could be pivotally adjustable rather than fixed. The hip pad mounts 39*a* and 39*b* and the attached support pads 38*a* and 38*b* are removably connected to the spars 28*a* and 28*b* respectively. It is foreseen that a single hip pad may be used instead of the pair of hip pads 38*a* and 38*b*.

The chest, shoulders, arms and head of the patient are supported by a trunk or torso translator assembly 43 that enables sliding translational movement of the head and upper body of the supported patient along a length of the upper body support frame 4 in both caudad and cephalad directions. The translational movement of the trunk translator 43 is coordinated or synchronized with the upward and downward angulation of the inboard or hinge ends of the upper and lower body patient supports 3 and 4.

Figure 4:
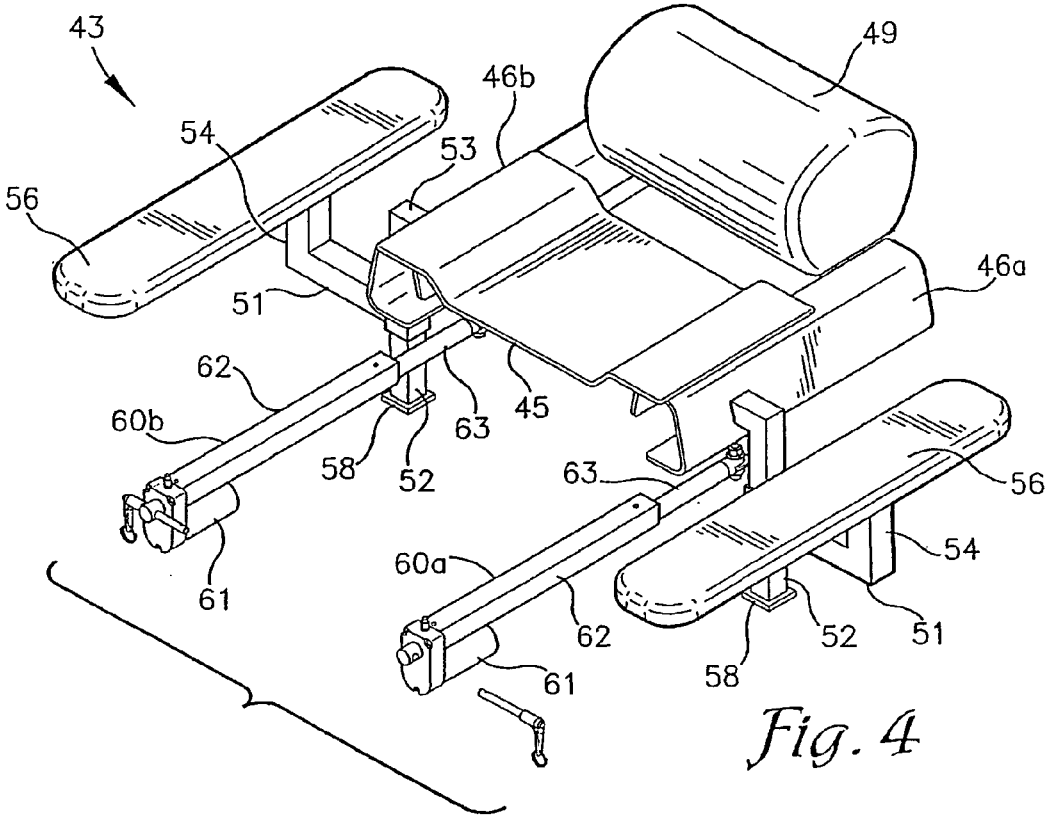
FIG. 4 is an enlarged and exploded perspective view of a trunk translator shown disengaged from the patient positioning structure of FIG. 1.
Figure 5:
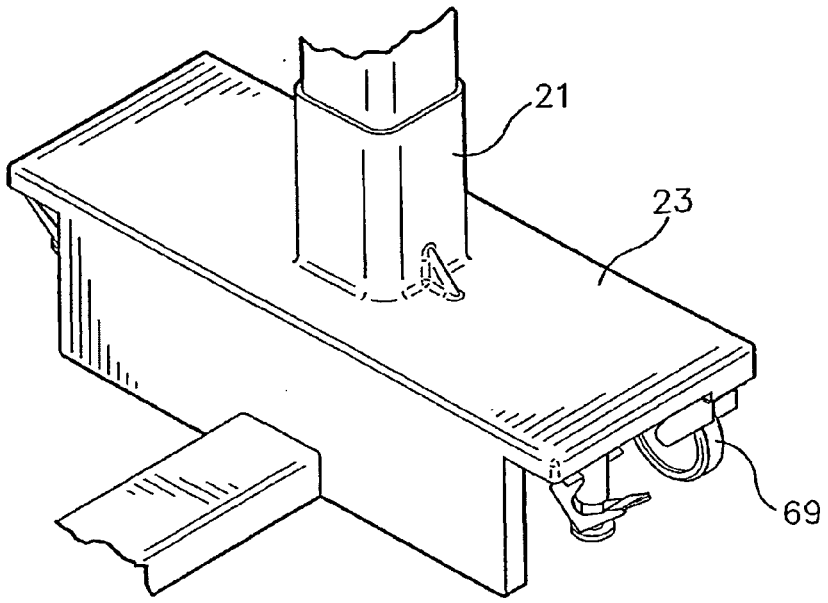
FIG. 5 is an enlarged fragmentary perspective view of the base of a head end support column of the patient positioning structure of FIG. 1.

The translator assembly 43 is constructed as a removable component or module, and is shown in FIG. 4 disengaged and removed from the structure 1. The translator assembly 43 includes a head support portion or trolley 45 that extends between and is supported by a pair of elongate support or trolley guides 46*a* and 46*b*. Each of the guides is sized and shaped to receive a portion of one of the spars 31*a* and 31*b* respectively of the upper body support frame 4. The guides 46*a* and 46*b* are preferably lubricated on their inner surfaces to facilitate shifting or sliding back and forth along the spars 31*a* and 31*b*. The guides 46*a* and 46*b* are interconnected at their inboard ends by a crossbar, cross brace or rail (not shown), which supports a sternum pad 49.

An arm rest support bracket 51 is connected to each of the trolley guides 46*a* and 46*b* respectively. The support brackets 51 are generally Y-shaped with a lower leg 52 and an inner and outer branched arm 53 and 54 respectively. The inner branched arm 53 of each support bracket 51 is connected to the associated trolley guide 46*a* and 46*b*. Each of the brackets 51 supports a respective arm rest 56. It is foreseen that arm-supporting cradles or slings may be substituted for the arm rests 56. Each lower leg 52 terminates in an expanded base 58, so that the two brackets 51 form a stand for supporting the trunk translator assembly 43 when it is removed from the patient support assembly 1.

The trunk translator assembly 43 includes a pair of linear actuators 60*a* and 60*b*. Each actuator includes a motor 61, a tubular housing 62 and an extendable shaft 63. A distal end of the shaft 63 of each actuator 60*a* and 60*b* is pivotally connected to a flange 65 depending from a respective trolley guide 46*a* and 46*b*. An opposite end of each linear actuator 60*a* and 60*b* is connected to a clevis 67 (see FIG. 2) projecting from respective spars 31*a* and 31*b*. The linear actuators 60*a* and 60*b* are controlled by computer controller 26 to adjust the position of the trunk translator 43 as the first and second support frames 3 and 4 pivot at the hinges 6 and 7 relative to one another. The actuators 60*a* and 60*b* preferably include integral position sensors which determine the degree of extension of the shaft 63 of each actuator and communicate this information to the controller 26. Because the linear actuators 60*a* and 60*b* are connected to the trunk translator assembly 43, the computer controller 26 can use the data to determine and coordinate the position of the trunk translator assembly 43 with respect to the spars 31*a* and 31*b*. Accordingly, the position or location of the trunk translator assembly 434 is synchronized with the position or angulation of the hinges 6 and 7 by the computer controller 26. Each of the linear actuators may incorporate an integral home switch, not shown. Cabling or the like for the actuators 60*a* and 60*b* is preferably routed within the patient support framework 8.

It is foreseen that the position of the trunk translator 43 may be adjusted by a drive linkage (not shown) incorporated into the patient support framework 8. Such a linkage would preferably extend through one or both of the spars 28*a* and 28*b* of the foot end patient support frame 3 and through one or both of the spars 31*a* and 31*b* of the head end patient support frame 4.

The base 23 of the second end or head end support column 21 may include spaced apart casters or wheels 69 each equipped with a floor-lock foot lever for lowering the base 23 into a floor-engaging position. The column 21 includes two or more telescoping lift segments, such as lower lift segment 71, medial lift segment 72 and upper lift segment 73 that permit the height of column 21 to be selectively increased and decreased in order to raise and lower the head end of the second patient support section 4. Telescoping movement of the lift segments 71-73 may be controlled by hydraulic actuators, screws or other lifting mechanisms (not shown) the operation of which are controlled by controller 26.

Figure 6:
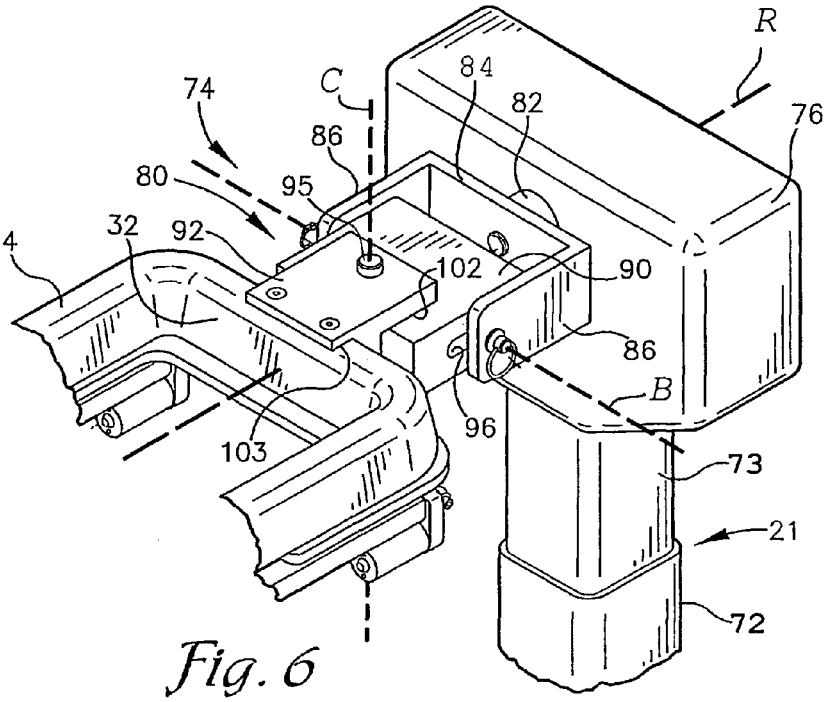
FIG. 6 is an enlarged and fragmentary, perspective view of the head end support column and a head end patient support of the patient positioning structure of FIG. 1.
Figure 7:
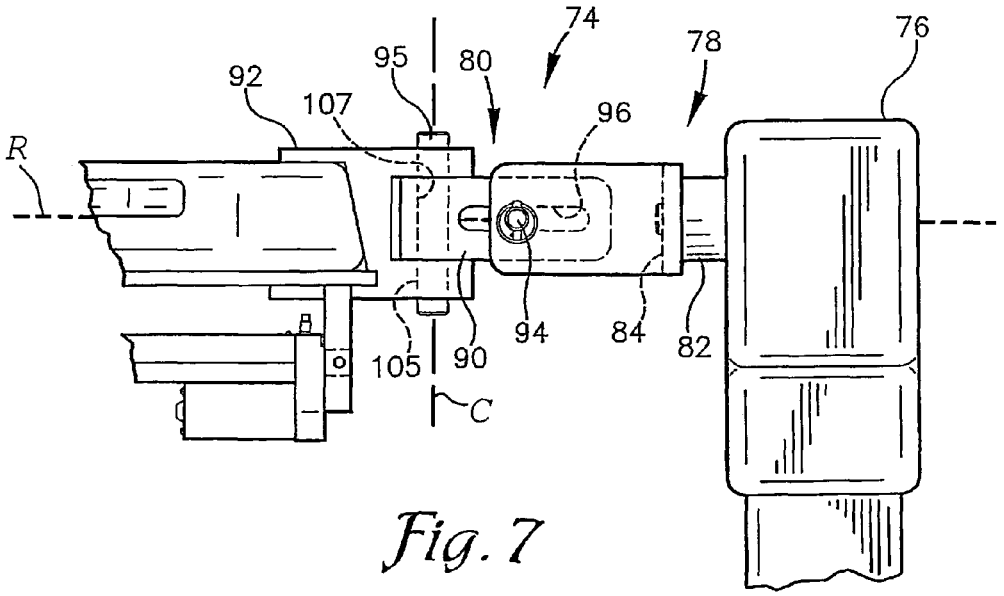
FIG. 7 is an enlarged and fragmentary, side, elevational view of the patient positioning structure of FIG. 1.

As best seen in FIGS. 6 and 7, the upper body patient support frame 4 is connected to the head end column 21 by a pivotal support frame linkage 74 which is connected to a head 76 of the upper lift segment 73. The support frame linkage 74 includes a rotation subassembly 78 and an angulation subassembly 80 that are interconnected as will be described in greater detail below. The rotation subassembly 78 enables side to side pivoting, tilting, rolling or rotation of the head end patient support frame 4 about a longitudinal axis of rotation R (see FIGS. 6-7) of the structure 1 in response to side to side pivoting of the carrier 11 by the pedestal pivot assembly 16. The angulation subassembly 80 enables pivoting, tilting or rotation of the head end patient support frame 4 about an axis B (see FIG. 6) extending laterally across the support frame linkage 74 which permits hinging or articulation of the patient support framework 8 at the hinges 6 and 7 at desired levels and increments as well as selective tilting of the patient support sections 3 and 4 with respect to a longitudinal axis of the support sections 3 and 4.

The rotation subassembly or mechanism 78, includes a longitudinal pivot shaft 82 pivotally mounted within and projecting from the upper lift segment head 76 and connected to a pivotal beam or strut 84. The pivot shaft 82 is substantially coaxial with the longitudinal axis of rotation R. A pair of flanges 86, each with a pin receiving aperture (not shown) formed therein, project outward from the beam 84 on opposite ends thereof and toward the foot end of the assembly 1. The beam 84 and flanges 86 generally form a clevis for connecting the angulation subassembly 80 thereto.

The angulation subassembly 80 generally includes a vertical angulating connector 90, a side to side pivot connector 92 and first and second pivot pins 94 and 95 associated therewith. Angulating connector 90 is positioned between and pivotally connected to the flanges 86 on beam 84 by first pivot pin 94 extending through pin receiving apertures in flanges 86 and through a first pivot bore 96, which in some embodiments is an elongate slot, extending laterally through the connector 90 such that the connector 90 pivots between the flanges 86. It is foreseen that in certain embodiments the bore 96 will not be required to be slot-shaped, to provide lateral translation compensation, because most or all of the longitudinal translation compensation may be actively provided in the foot end structures, such as but not limited to carriers 11 and similar translation structures.

The side to side pivot connector 92 connects the angulating connector 90 to the head end cross bar 32 of the head end patient support frame 4. The pivot connector 92 includes first and second outwardly opening and opposed slots 102 and 103 formed therein. The first slot 102 is sized and shaped for receiving the angulating connector 90 and the second slot 103 is sized and shaped for receiving the head end cross bar 32. The pivot connector 92 further includes a through bore 105 running substantially perpendicular to the first slot 102 and communicating therewith. The bore 105 is aligned with a second pivot bore 107 extending generally vertically through the angulating connector 90 with the second pivot pin 95 extending therethrough to permit the pivot connector 92 to pivot side to side relative to the angulating connector 90 providing a degree of freedom and clearance needed for rotation the patient support about a longitudinal axis of a patient. The head end cross bar 32 is fixedly secured within second slot 103.

It is noted that the first pivot pin 94 is substantially coaxial with the axis B, which may be referred to as a pitch axis B. The second pivot pin 95 is substantially coaxial with a yaw rotational axis denoted by the letter C (see FIGS. 6-7), which enables at least some rotational movement of the side pivot connector 92 with respect to the vertical angulating connector 90.

Although the rotation subassembly 78 and the angulation subassembly 80 are generally shown as passive and allowing movement in response to active movement of the patient support framework 8 by the pedestal 12, it is foreseen that drive means, such as a motor connected to shaft 82 could be used to actively rotate the shaft 82 and the head end patient support frame 4 and further actuating means could be used to pivot the head end patient support frame 4 relative to the rotation subassembly 78. It is foreseen that the rotation subassembly 78 and the angulation subassembly 80 may be any other structure that enables rotational movement with respect to the axes R, B and C, such as but not limited to universal joints, ball joints and the like.

Figure 8:
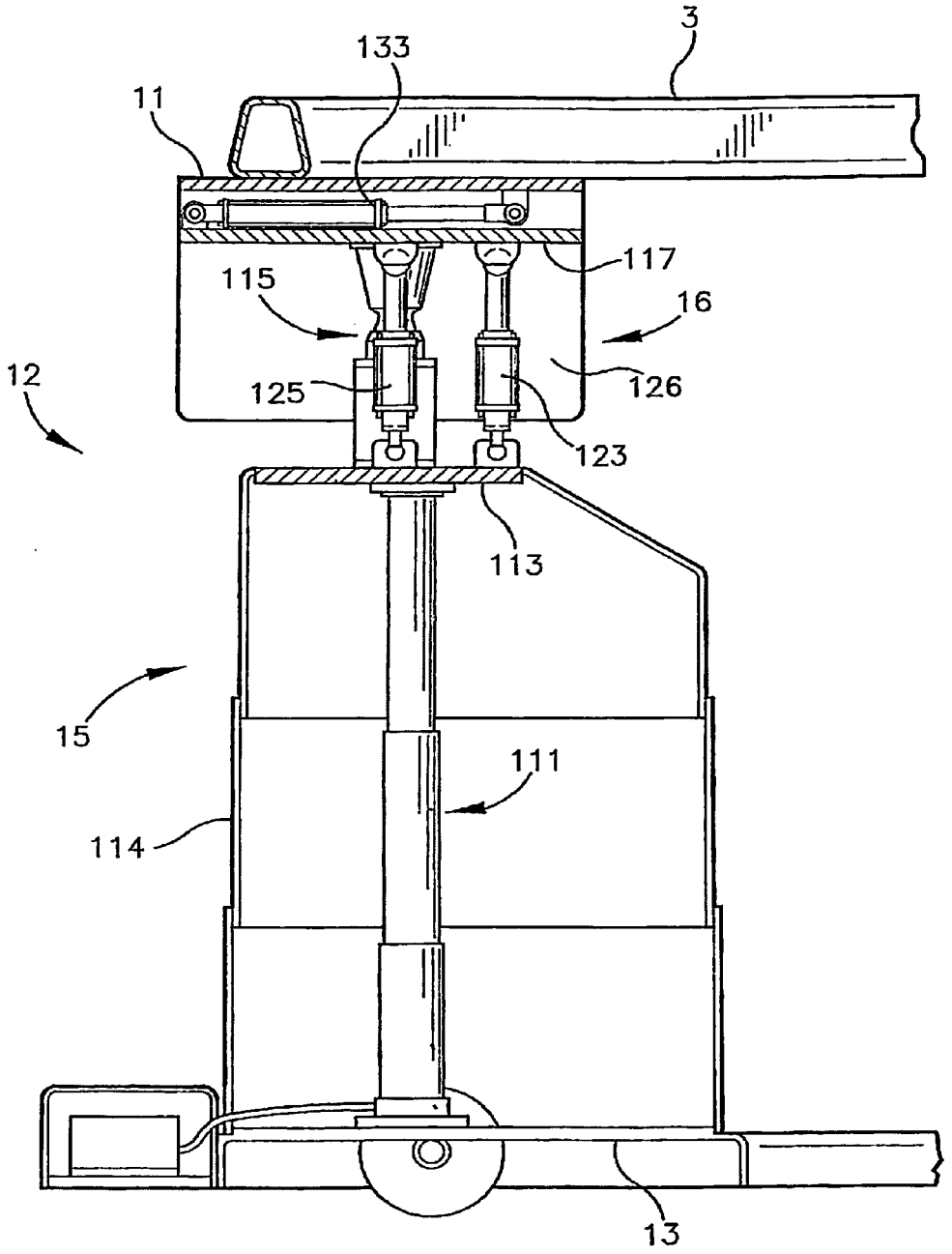
FIG. 8 is an enlarged and fragmentary, cross-sectional view of the patient positioning structure of FIG. 1, taken along line 8-8 of FIG. 3.
Figure 9:
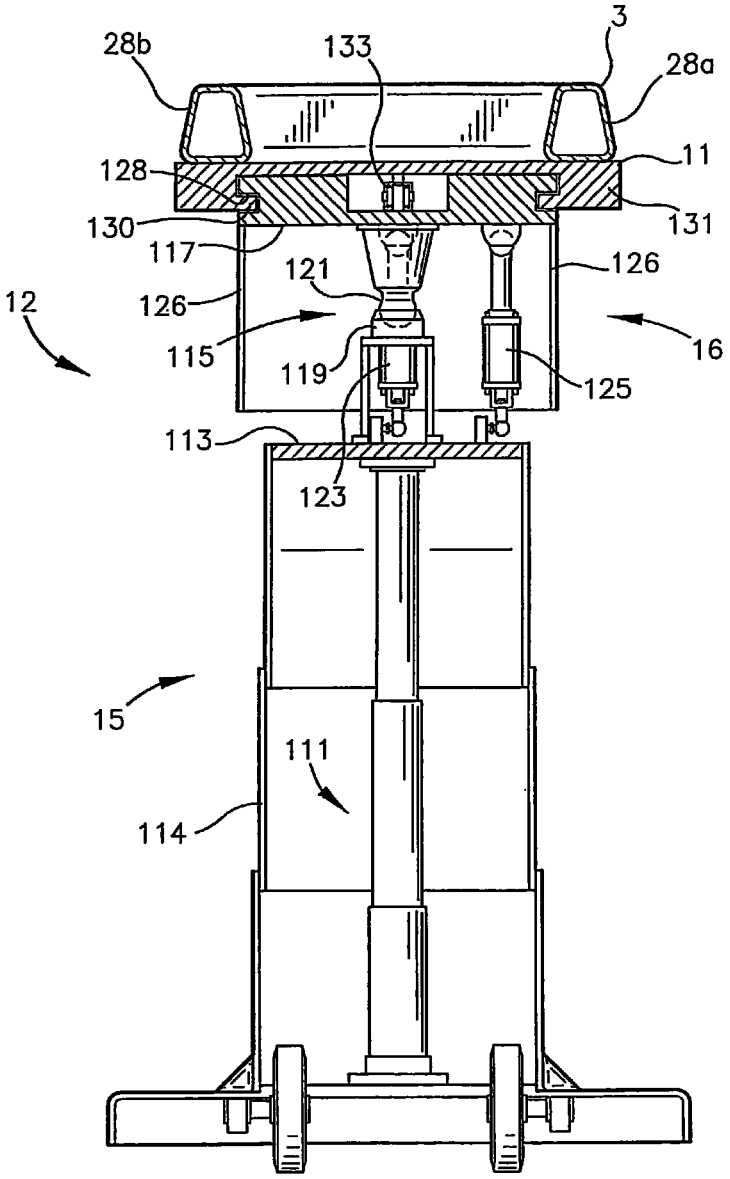
FIG. 9 is an enlarged and fragmentary, cross-sectional view of the patient positioning structure of FIG. 1, taken along line 9-9 of FIG. 2.
Figure 10:
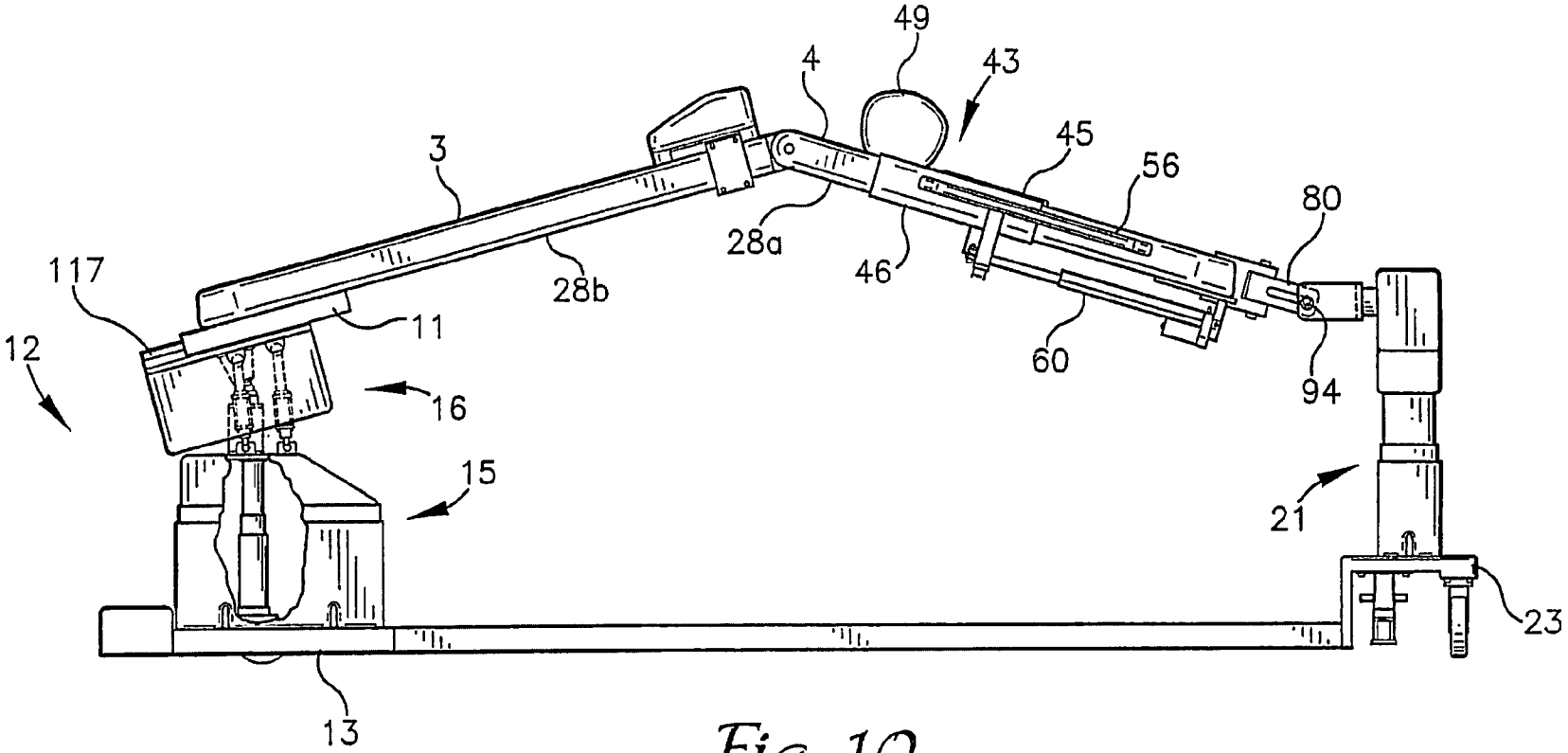
FIG. 10 is a side, elevational view of the patient positioning structure of FIG. 1 showing foot end and head end patient supports pivoted in an upward breaking position and the pedestal and head end support column in lowered positions.

Referring to FIGS. 8-10, the lift assembly 15 of the pedestal 12 is shown as a jack 111 supported on the foot end base 13 and supporting a lift plate 113 connected to the jack 111. Jack 111 as shown may be hydraulically or mechanically actuated and operation of the jack 111 is controlled by controller 26. Extension of the jack 111 raises the lift plate 113 and retraction of the jack 111 lowers the lift plate 113. A flexible or expandable enclosure 114 preferably surrounds the lift assembly 15 and is connected at one end to the lift plate 113 and at the other end to the base 13. The enclosure 114 telescopes or expands and contracts as the lift plate 113 is raised and lowered.

The pedestal pivot assembly 16 includes a ball joint 115 connecting a swivel plate or panel 117 to the lift plate 113. The ball joint 115 as shown includes a socket 119 mounted on top of the lift plate 113 and a ball member 121 connected to and depending from the swivel plate 117 and received in socket 119. One or more linear actuators 123 (one shown) are operable to tilt or pivot the swivel plate 117 in a fore and aft direction relative to foot end base 13. One or more linear actuators 125 (one shown) are operable to pivot or roll the swivel plate 117 side to side relative to the foot end base 13. The linear actuators 123 and 125 may be hydraulic or mechanical actuators or the like and operation of the actuators 123 and 125 is controlled by controller 26. Safety panels or shielding 126 depends from the swivel plate 117 along the sides and across the outer end of the pivot assembly 16.

The carrier 11 is slidably mounted on the swivel plate 117 and slides longitudinally relative thereto. In the embodiment shown, the swivel plate 117 includes grooves 128 formed along the sides of the swivel plate 117 which receive opposed flanges 130 which project inwardly from legs 131 extending downwardly from the carrier 11. A linear actuator 133 connected between the swivel plate 117 and the carrier 11 is operable by the controller 26 to slide the carrier 11 longitudinally relative to the swivel plate 117. The carrier 11 may be described as supporting the lower body patient support frame 3 in cantilevered relationship. The pedestal 12 and base 13 extend below the carrier 11 and a distal portion of lower body support frame 3 to support the support frame 3 in a cantilevered arrangement. In the embodiment shown, the spars 28*a* and 28*b* of the lower body support frame 3 extend above the carrier 11 and pedestal 12 to provide unobstructed access to the patient supported thereon with equipment that can move over the foot end of the table 1.

Figure 11:
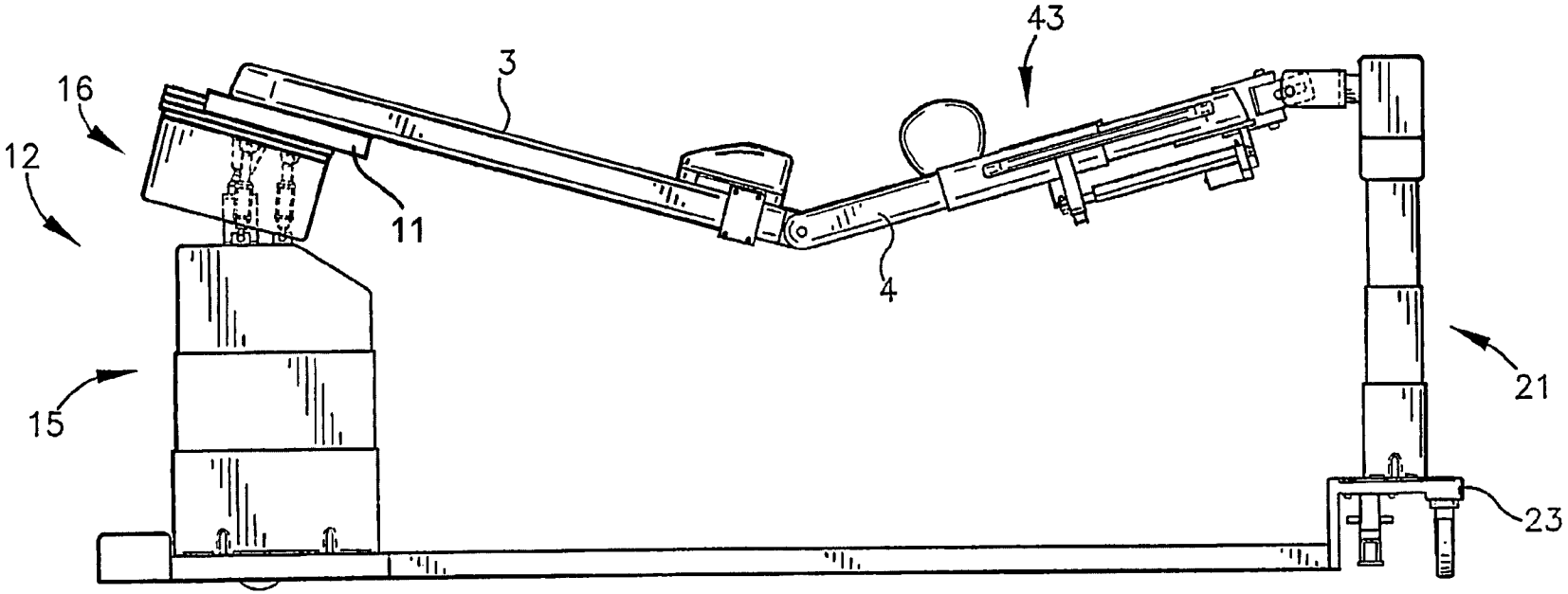
FIG. 11 is a side, elevational view of the patient positioning structure of FIG. 1 showing the foot end and head end patient supports pivoted in a downward breaking position and with the pedestal and head end support column in raised positions.

A user controls the positioning of the patient support framework 8 with a hand held controller 140 which communicates with the computer control system 26 which in turn controls the operation of the actuators and motors incorporated into the patient support structure 1. Extending linear actuator 123, tilts the swivel plate 117, the attached carrier 11 and the lower body support frame 3 extending toward hinges 6 and 7 upward which results in the patient support framework 8 breaking upward as shown in FIG. 10. Retracting linear actuator 123 tilts the swivel plate 117, attached carrier 11 and the lower body support frame 3 extending toward the hinges 6 and 7 downward which results in the patient support framework 8 breaking downward as shown in FIG. 11. As the hinge end of the lower body support frame 3 is raised or lowered, the adjacent hinge end of the upper body support frame 4 is raised or lowered due to its connection to the lower body support frame 3. The upper body support frame 4 pivots about pivot pin 94 in the angulation subassembly 80 as the hinge end thereof rises and lowers.

As the lower body support frame 3 and upper body support frame 4 pivot from horizontal, the distance between the distal or outer ends of the support frames 3 and 4 decreases while the distance between the foot end base 13 and head end base 23 remains fixed. Sliding of the carrier 11 relative to the swivel plate 117 accommodates the reduction in distance between the ends of the support frames 3 and 4. As the lower and upper body support frames 3 and 4 pivot upward, the carrier plate 11 generally slides toward the head end of the patient support assembly 1. As the lower and upper body support frames 3 and 4 pivot downward, because the pivot point is below the carrier, the carrier 11 generally slides away from the head end of the patient support assembly 1.

The controller 26 preferably controls the operation of actuators 60 for adjusting the position of the trunk translator 43 in response to changes in the breaking angle between the lower and upper body support frames 3 and 4. Sensors, not shown, may be incorporated into the lower and upper body support frames 3 and 4 proximate hinges 6 and 7 to determine the breaking angle and use the sensed angle to operate actuators 60 to adjust the position of the trunk translator 43. It is also foreseen that an operator can separately control the operation of actuators 60 and the position of the trunk translator 43 using the hand held controller 140. It is also foreseen that the actuators 60 could be replaced by other types of drive linkages to control operation of the trunk translator 43, including a drive linkage extending through the spars 28*a* and 28*b* and 31*a* and 31*b* of the support frames 3 and 4.

The trunk translation assembly 43 enables coordinated shifting of the patient's upper body along the longitudinal axis of the patient support 11 as required for maintenance of normal spinal biomechanics and avoidance of excessive traction or compression of the spine as the breaking angle between the lower and upper body support frames 3 and 4 is adjusted.

Positioning of the translator assembly 43 may be based on positional data collection by the computer in response to inputs by an operator. The assembly 43 is initially positioned or calibrated within the computer by a coordinated learning process and conventional trigonometric calculations. In this manner, the trunk translator assembly 43 is controlled to travel or move a distance corresponding to the change in overall length of the base of a triangle formed when the inboard ends of the patient support frames 3 and 4 are angled upwardly or downwardly. The base of the triangle equals the distance between the outboard ends of the patient support frames 3 and 4. The distance of travel of the trunk translator assembly 43 may be calibrated to be identical to the change in distance between the outboard ends of the patient support frames 3 and 4, or it may be approximately the same. The positions of the patient support frames 3 and 4 are measured as they are raised and lowered, the assembly 43 is positioned accordingly and the position of the assembly is measured. The data points thus empirically obtained are then programmed into the computer controller 26.

The actuator or actuators 60 drive the trolley guides 46 supporting the trolley 45, sternum pad 49 and arm rests 56 back and forth along the spars 31*a* and 31*b* in coordinated movement with the spars 28*a* and 28*b*. By coordinated operation of the actuators 60 with the angular orientation of the lower and upper body patient support frames 3 and 4, the trolley 45 and associated structures are moved or translated in a caudad direction, traveling along the spars 31*a* and 31*b* toward the inboard articulation thereof, in the direction of the patient's feet when the ends of the spars are raised to an upwardly breaking angle as seen in FIG. 10, thereby avoiding excessive traction on the patient's spine. Conversely, by reverse operation of the actuators 60, the trolley 45 and associated structures are moved or translated in a cephalad direction, traveling along the spars 31*a* and 31*b* away from the inboard articulation of the patient support frames 3 and 4, in the direction of the patient's head when the ends of the spars are lowered to a downwardly breaking angle as seen in FIG. 11, thereby avoiding excessive compression of the patient's spine. It is foreseen that the operation of the actuators may also be coordinated with the tilt orientation of the patient support frames 3 and 4. When not in use, the translator assembly 43 preferably is easily removed from the spars 31*a* and 31*b*.

Operating linear actuators 125 to roll or pivot the swivel plate 117 side to side causes the carrier plate 11 and the lower body support frame 3 to pivot or roll side to side and the rotation subassembly 78 simultaneously allows side-to-side pivoting or rolling of the upper body support frame 4 about pivot shaft 82. It is to be understood that the head end cross bar 32 can pivot about pivot pin 95 through pivot connector 92 to prevent binding when the patient support frames 3 and 4 roll side to side, particularly when the support frames 3 and 4 are in upwardly or downwardly breaking angular orientation relative to one another.

The height of the foot end of lower body support frame 3 is adjusted by extending or retracting jack 111, the operation of which can be controlled through hand held controller 140. Similarly, the height of the head end of upper body support frame 4 is adjusted by extending the middle and upper lift segments 72 and 73 relative to lower lift segment 71 of the head end support column 21 which may be controlled by hand held controller 140 interfacing with computer controller 26. One or more linear actuators, not shown, mounted within the head end support column 21 may be used for raising and lowering the lift segments 72 and 73 relative to lift segment 71. The upper body support frame 4 similarly pivots about pivot pin 94 in angulation subassembly 80 as the height of the head 76 of upper lift segment 73 rises and lowers.

The patient support frames 3 and 4 may be positioned in a horizontal or other convenient orientation and height to facilitate transfer of a patient onto the translator assembly 43 and hip supports 38. The patient may be positioned, for example, in a generally prone position with the head supported on the trolley 45, and the torso and arms supported on the sternum pad 49 and arm supports 56 respectively. A head support pad may also be provided atop the trolley 45 if desired. Once the patient is positioned on the translator assembly 43 and hip supports 38 or otherwise positioned on the support frames 3 and 4, the controller 26 is then used to control the operation of the patient support structure 1 to position the patient in the desired alignment for the surgical procedure to be performed. As discussed previously, jack 111 is used to adjust the height of the foot end of the patient support framework 8 while head end support column 21 is adjusted to control the height of the head end of the framework 8. Fore and aft pivoting of swivel plate 117 adjusts the breaking angle between the patient support frames 3 and 4 and side to side pivoting of the swivel plate 117 causes rolling of the support frames 3 and 4.

Figure 12:
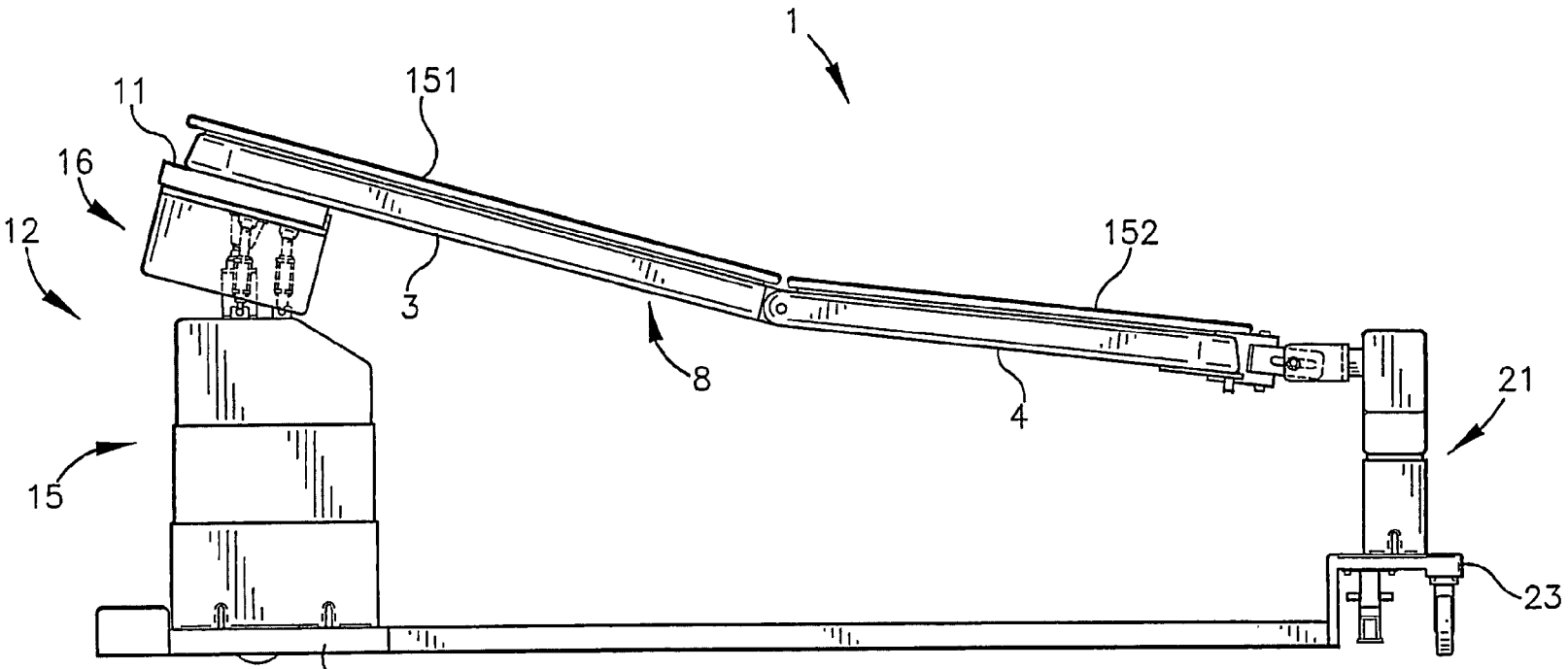
FIG. 12 is a side elevational view of the structure of FIG. 1 shown with a pair of planar patient support surfaces replacing the patient supports of FIG. 1 and showing the pedestal raised and the head end support column lowered.
Figure 13:
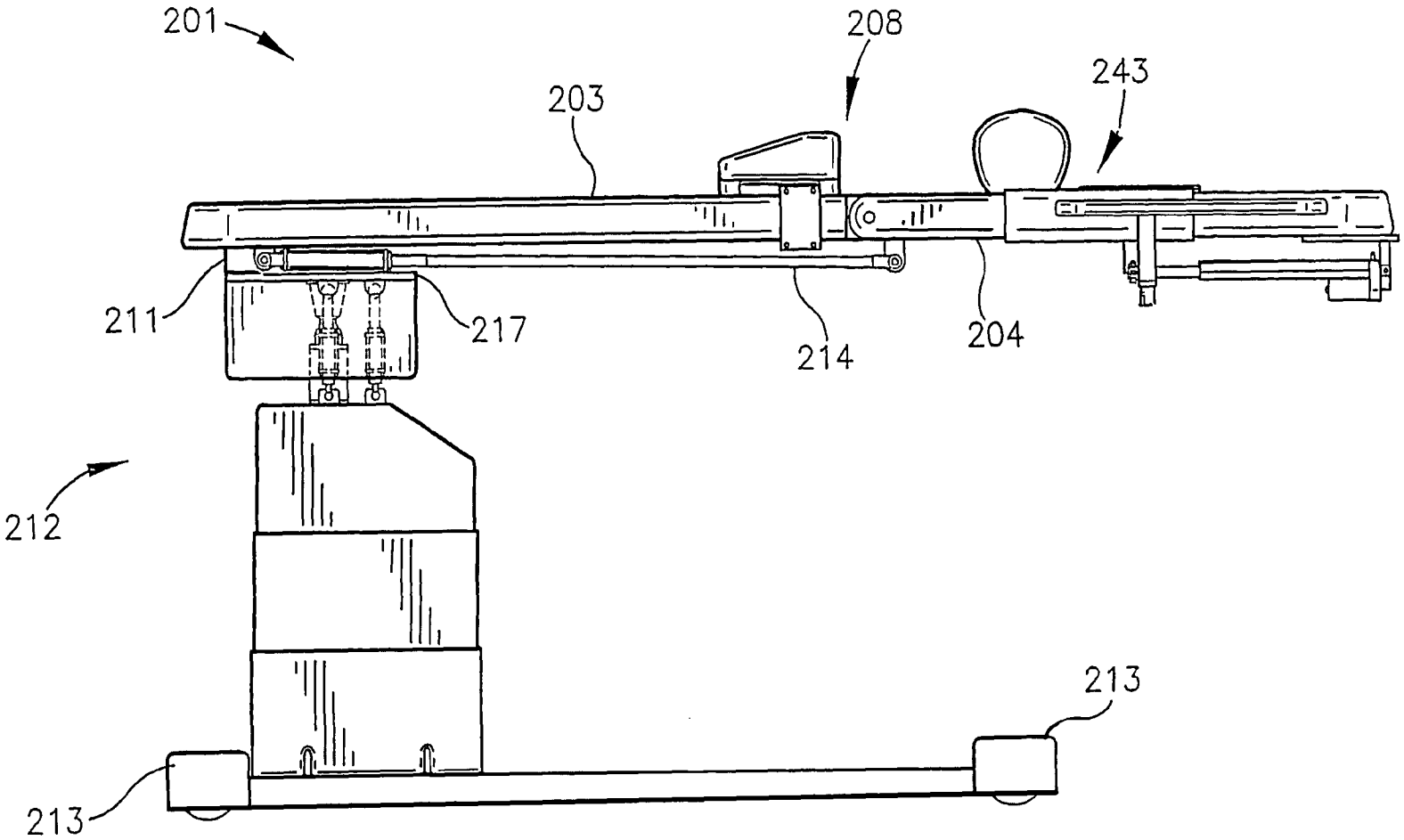
FIG. 13 is a side elevational view of an alternative embodiment showing a cantilevered patient positioning structure with a pedestal base supporting a foot end patient support and a head end patient support connected to and supported as a cantilever through the foot end patient support.
Figure 14:
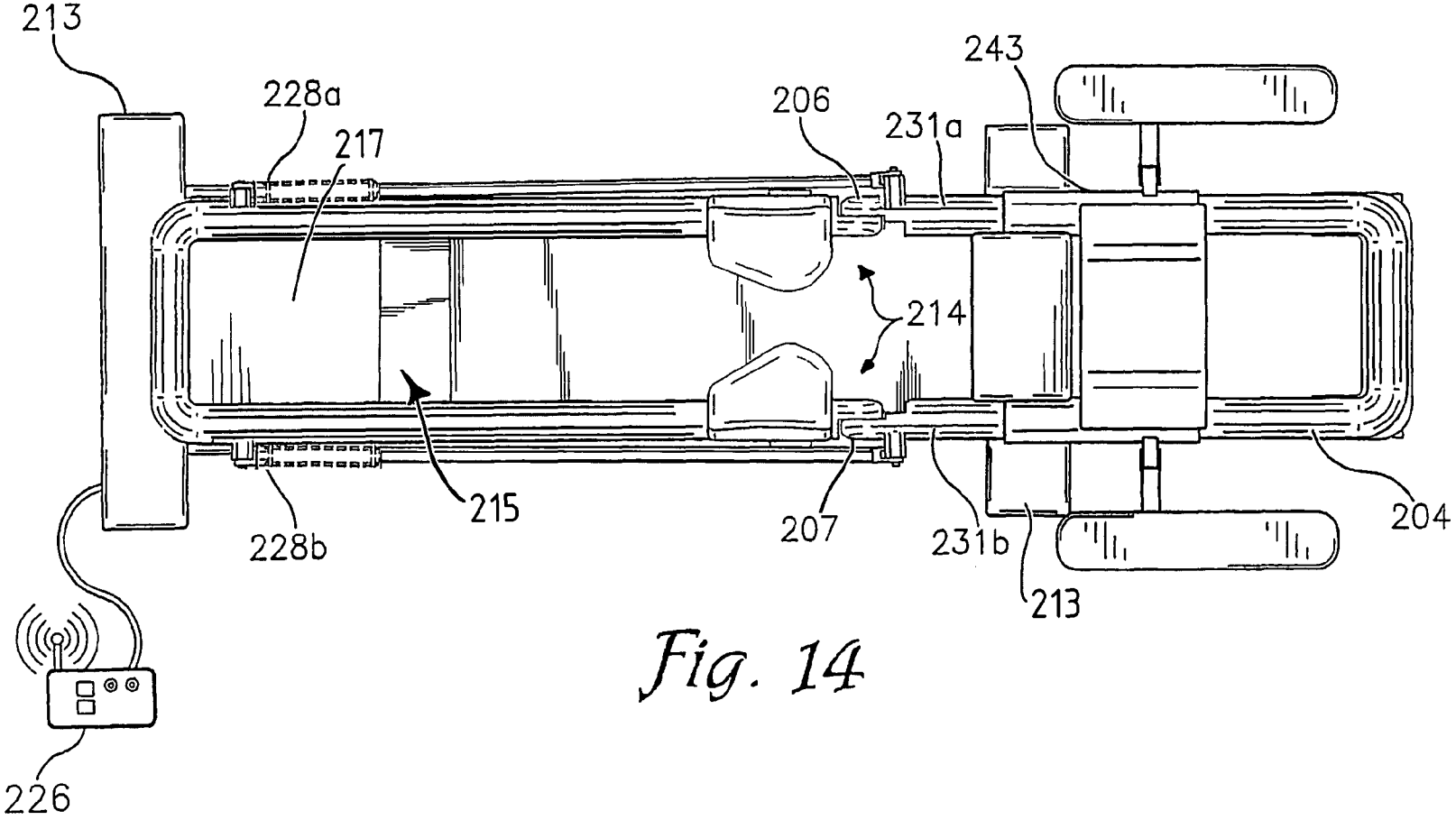
FIG. 14 is a top plan view of the cantilevered patient positioning structure as shown in FIG. 13.

FIG. 12 shows the support table 1 with the trunk translator assembly 43 and the hip supports 38 removed from the patient support framework 8 and replaced with lower and upper body support panels 151 and 152 for supporting a patient thereon. The lower body support panel 151 is connected to lower body support frame 3 and upper body support panel 152 is connected to upper body support frame 4 by bolting, clips or other fastening means. The patient is then supported on the panels 151 and 152, in a prone, supine or lateral position. The panels 151 and 152 move with the support frames 3 and 4 to which they are attached.

An alternative embodiment of a patient support assembly 201 is shown in FIGS. 13-16 and includes lower body and upper body support frames 203 and 204 which are connected together by hinges 206 and 207. Patient support assembly 201 is constructed similar to assembly 1, except that the head end of upper body support frame 204 is unsupported such that the patient support framework 208 is supported in a cantilevered fashion on the carrier 211 and pedestal 212. The base 213 of the pedestal 212 is preferably enlarged relative to base 13 of assembly 1 to prevent tipping of the cantilevered support assembly 201.

By supporting the patient support framework 208 above and only through the foot end pedestal 212, diagnostic or imaging equipment may be more readily positioned relative to the patient supported on the framework 208 to procure images during a surgical procedure. As seen in the drawings, the upper body support frame 204 is only supported above the ground through its connection to and through the lower body support frame 203.

Articulation of the upper body support frame 204 relative to the lower body support frame 203 in assembly 201 is controlled by actuators, such as linear actuators 214 connected between spars 228*a* and 231*a* and spars 228*b* and 231*b* of the patient support frames 203 and 204. Operation of the actuators 214 to control the breaking angle between patient support frames 203 and 204 is controlled by computer controller 226. Because the upper body support frame 204 is only supported through the lower body support frame 203, the lower body support frame 203 is not required to slide relative to the pedestal 212. In this embodiment, a carrier separate from the swivel plate 217 is not required and the swivel plate 217 may be described as or considered the carrier for the lower body support frame or section 203.

Figure 15:
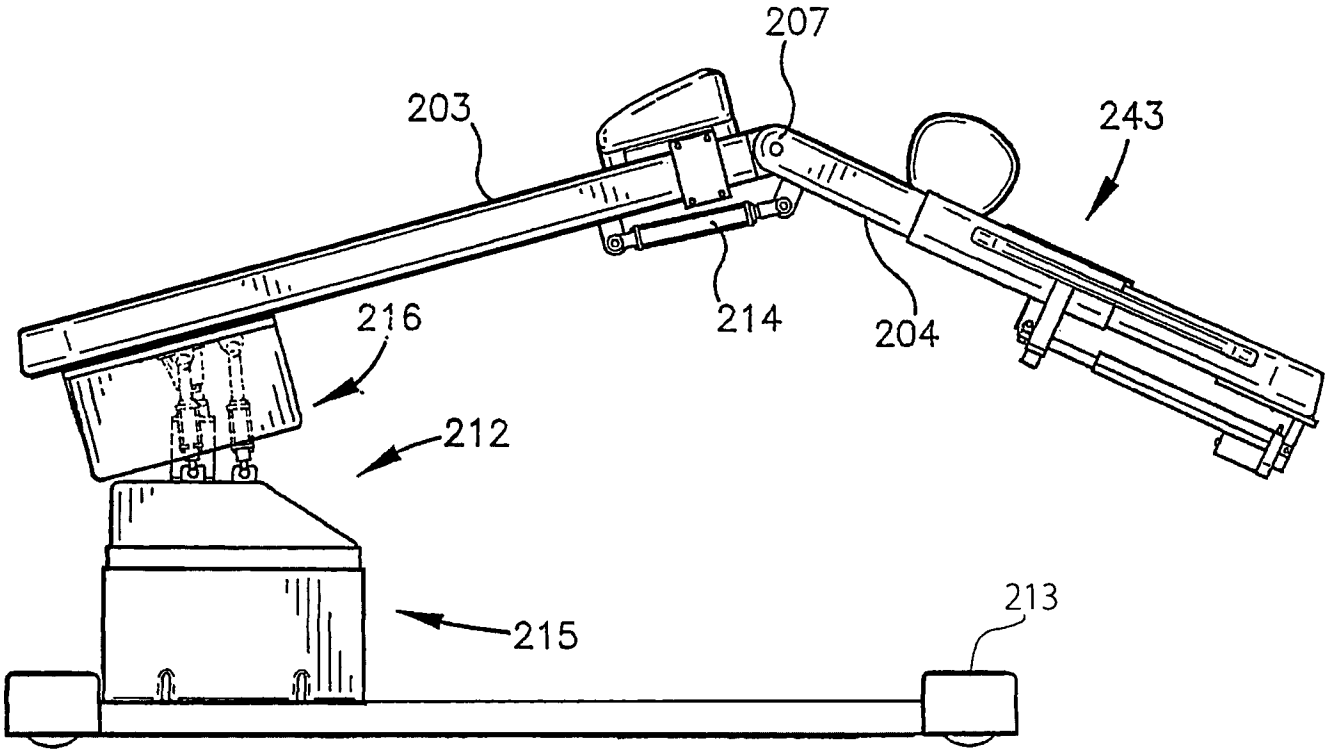
FIG. 15 is a side elevational view of the cantilevered patient positioning structure of FIG. 13 showing the foot end and head end patient supports pivoted in an upwardly breaking orientation.
Figure 16:
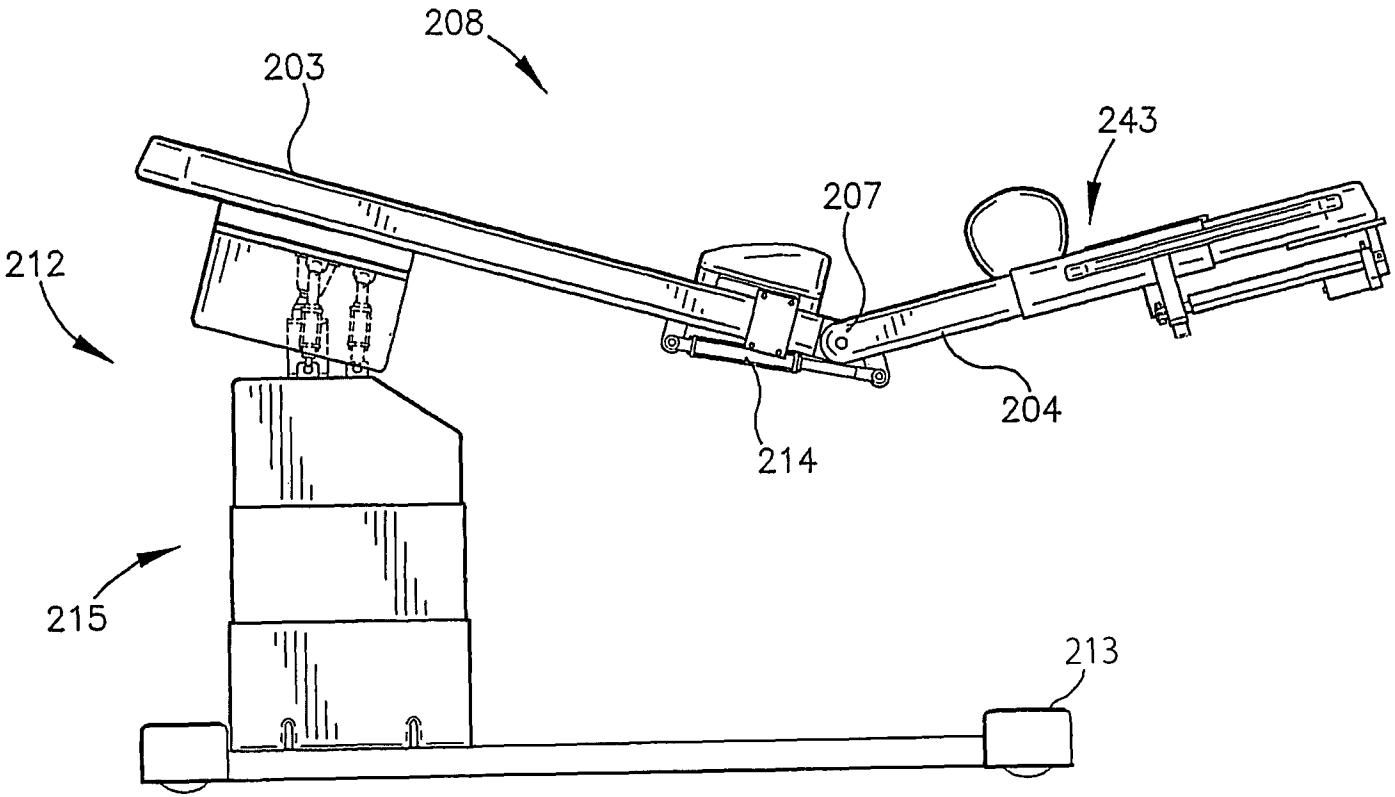
FIG. 16 is a side elevational view of the cantilevered patient positioning structure of FIG. 13 showing the foot end and head end patient supports pivoted in a downwardly breaking orientation and a trunk translator moving toward a head end of the head end patient support.

The lower body and upper body support sections 203 and 204 are shown in an upwardly breaking orientation in FIG. 15 and in a downward breaking position in FIG. 16, with the pedestal retracted in FIG. 15 and extended in FIG. 16. A trunk translator assembly 243 similar in construction and operation as trunk translator 43 is mounted on the spars 231*a* and 231*b* of the upper body support frame 204.

It is foreseen that in some embodiments that the actuator that moves the trunk translator relative to the housing may not be directly secured or affixed to the translator. In particular, an additional trolley may be utilized that rides on the frame or housing and that is secured to the actuator. The trunk translator portion that supports the patient is then separate from the trolley and removably sits on top of the trolley. The trolley may include vertical projections or the like to hold the translator so as to move with the trolley when placed thereon. It is also foreseen that the actuator may be enclosed within the frame or housing for a reduced profile.

In an exemplary embodiment, an apparatus 1 for supporting a patient above a floor during a medical procedure is provided, including an elongate patient support structure having a first section 3 hingedly connected to a second section 4 by a pair of spaced apart opposed hinges 6 and 7, a base and a chest slide 43. The base includes spaced opposed upright first and second end supports 12 and 21, respectively. The first end support 12 is connected to an outer end of the first section 3 by a cantilever lifting mechanism 15 configured to move the hinges 6 and 7 upwardly and downwardly when the second end support 21 is connected to an outer end of the second section 4, wherein at least one of the end connections therebetween is configured to provide for three degrees of rotational freedom including pitch, roll and yaw. For example, pitch may be provided by rotational movement about one or both of the hinge axes A and B, roll may be provided by rotational movement with respect to the longitudinally extending roll axis R, and yaw may be provided by rotational movement about the axis C associated with the pivot pin 95. The a chest slide 43 is operational along at least one portion of at least one section of the patient support structure and in slidable relation therewith, wherein the chest slide 43 is mechanically non-linked to either of the hinges 6 and 7. For example, the chest slide 43 may slidingly translate longitudinally along a length of the second section 4. In a further embodiment, each of the first and second sections 3 and 4 is an open frame adapted for a patient's belly to depend therethrough or an imaging table top 151 and 152. In another further embodiment, the hinges 6 and 7 are spaced apart or otherwise adapted for a patient's belly to depend therebetween. In another further embodiment, the chest slide 43 is reversibly attachable to the section 3 or 4 of the patient support structure. In another further embodiment, there is no second end support 21 and the hinges 6 and 7 are passively moved by the cantilevered lifting mechanism. In yet another embodiment, the chest slide 43 is actively driven by an actuator or motor 61 that is synchronized with the angulation of the hinges 6 and 7 by a computer software program such as but not limited by controller 26. Numerous variations are foreseen.

It is to be understood that while certain forms of the patient positioning support structure have been illustrated and described herein, the structure is not to be limited to the specific forms or arrangement of parts described and shown.

The following is claimed and desired to be secured by Letters Patent:

1. An apparatus for supporting and positioning a patient during a medical procedure, the apparatus comprising:

a) a base supported on a floor and supporting only a single end support extending upward from the base;

b) a patient support structure having an open frame extending along a longitudinal axis, a first section having a first outer end and a first inner end, and a second section having a second outer end and a second inner end, said patient support structure pivotally coupled with and extending off of the single end support at or near the first outer end of the first section in a cantilevered fashion so as to pivot the patient support structure about an axis that is transverse to the longitudinal axis, the first outer end of the first section configured to articulate relative to the single end support about the axis at an outboard articulation and the second outer end of the second section being located at an opposite end of the patient support structure opposite the single end support, the first and second inner ends being connectable by and having an inboard articulation comprising a pair of space opposed joints;

c) a trunk translator assembly and at least one actuator, the trunk translator assembly slidably mounted to the second section of the patient support structure and configured to support an upper body of the patient, the at least one actuator coupled to a portion of the patient support structure at a first end and to the trunk translator assembly at a second end, the at least one actuator configured to translate the trunk translator assembly along the second section of the patient support structure, the at least one actuator being controlled via a computer controller; and d) said single end support including an angulation mechanism operable to selectively position said patient support structure in a plurality of angular orientations at the inboard articulation.

2. The apparatus of claim 1, wherein the open frame comprises a first patient support frame and a second patient support frame.

3. The apparatus of claim 2, wherein each of the first and second patient support frames comprises one of the pair of inboard ends at the inboard articulation.

4. The apparatus of claim 2, wherein said single end support includes an angulation mechanism operable to selectively position said first patient support frame of the patient support structure in a plurality of angular orientations relative to the second patient support frame at the inboard articulation.

5. The apparatus of claim 1, wherein the portion of the patient support structure comprises the second outer end of the second section.

6. The apparatus of claim 1, wherein a position of the trunk translator assembly on the second section of the patient support structure is configured to be synchronized with an angular orientation of the first and second sections of the patient support structure relative to each other.

7. The apparatus of claim 1, wherein the at least one actuator comprises at least one position sensor for determining an amount of actuation of the at least one actuator.

* * * * *